US011529640B2

(12) United States Patent
Presche

(10) Patent No.: US 11,529,640 B2
(45) Date of Patent: Dec. 20, 2022

(54) DISPENSER FOR DISCHARGING FLOWABLE COMPOUNDS

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 17/436,195

(22) PCT Filed: Mar. 4, 2020

(86) PCT No.: PCT/EP2020/055696
§ 371 (c)(1),
(2) Date: Sep. 3, 2021

(87) PCT Pub. No.: WO2020/178339
PCT Pub. Date: Sep. 10, 2020

(65) Prior Publication Data

US 2022/0126314 A1 Apr. 28, 2022

(30) Foreign Application Priority Data

Mar. 5, 2019 (DE) ..... 10 2019 105 569.5
Aug. 26, 2019 (DE) ..... 10 2019 122 841.7

(51) Int. Cl.
*B05B 11/00* (2006.01)

(52) U.S. Cl.
CPC ..... *B05B 11/3007* (2013.01); *B05B 11/3033* (2013.01); *B05B 11/3047* (2013.01); *B05B 11/3069* (2013.01); *B05B 11/3074* (2013.01)

(58) Field of Classification Search
CPC ..... B05B 11/3007; B05B 11/3033; B05B 11/3047; B05B 11/3069; B05B 11/3074
See application file for complete search history.

(56) References Cited

U.S. PATENT DOCUMENTS 2,593,591 A * 4/1952 Menkin ..... B05B 11/3007 222/309
3,194,447 A * 7/1965 Brown ..... B05B 11/3097 222/321.9

(Continued)

FOREIGN PATENT DOCUMENTS

DE 297 1 7 036 U1 1/1999
DE 10 2005 049 531 A1 10/2006

(Continued)

OTHER PUBLICATIONS

International Search Report of PCT/EP2020/055696, dated Jun. 26, 2020.

*Primary Examiner* — Donnell A Long
(74) *Attorney, Agent, or Firm* — Collard & Roe, P.C.

(57) ABSTRACT

A dispenser for discharging flowable compounds has a reservoir for holding the compound and a dispensing pump. The dispenser has a longitudinal axis. The dispensing pump has an inflow and an outflow channel, a pumping chamber which is delimited on the inflow and outflow sides by valves, and a head piece. The head piece has a dispensing opening. A pumping part can be moved relative to a cup part against an elastic force of a restoring device in order to achieve a pumping stroke, and the head piece is coupled to the pumping part with respect to motion such that a motion of the head piece from a completely depressed position to a reachable extension height corresponds to the pumping stroke. A variable limiting device is provided for variably limiting the pumping stroke and a change in the pumping stroke corresponds to a change in the extension height.

13 Claims, 19 Drawing Sheets

(56) References Cited

U.S. PATENT DOCUMENTS

| | | | | | |
|---|---|---|---|---|---|
| 3,779,464 | A * | 12/1973 | Malone | B05B 11/0013 | 239/350 |
| 4,081,111 | A * | 3/1978 | Sandow | B05B 11/3007 | 222/321.9 |
| 6,371,333 | B2 | 4/2002 | Lorscheidt et al. | | |
| 2012/0024907 | A1* | 2/2012 | Law | B05B 11/3074 | 222/256 |

FOREIGN PATENT DOCUMENTS

| | | | | |
|---|---|---|---|---|
| DE | 10 2007 007 402 | A1 | 8/2007 | |
| DE | 102007007402 | A1 * | 8/2007 | B05B 11/3001 |
| DE | 20 2008 011 730 | U1 | 10/2009 | |
| EP | 1 015 340 | B1 | 5/2003 | |
| EP | 1 460 001 | A1 | 9/2004 | |
| JP | 3068498 | U | 5/2000 | |

* cited by examiner 1
22
24
21
x
23
31
32
27
II
28
13
15
10
9
P
11
14
12
M
43
2
4
x
5
7
25
16
30
29
H
H'
6
18
20
17
F
8
44
19
3

DISPENSER FOR DISCHARGING FLOWABLE COMPOUNDS

CROSS REFERENCE TO RELATED APPLICATIONS

This application is the National Stage of PCT/EP2020/055696 filed on Mar. 4, 2020, which claims priority under 35 U.S.C. § 119 of German Application No. 10 2019 105 569.5 filed on Mar. 5, 2019 and German Application No. 10 2019 122 841.7 filed on Aug. 26, 2019, the disclosures of which are incorporated by reference. The international application under PCT article 21(2) was not published in English.

TECHNICAL FIELD

The invention pertains to a dispenser for discharging flowable compounds such as liquid or pasty compounds, wherein said dispenser comprises a reservoir for accommodating the compound and a dispensing pump, wherein the dispenser has a longitudinal axis, wherein the dispensing pump furthermore has an inflow channel and an outflow channel and a pumping chamber, which is delimited by valves on the inflow side and the outflow side, as well as a head piece, wherein the head piece has a dispensing opening, wherein a pumping part can be moved relative to a cup part against an elastic force of a restoring device in order to achieve a pumping stroke, and wherein the head piece is motion-coupled with the pumping part such that a motion of the head piece from a completely depressed position to an attainable extension height corresponds to the pumping stroke.

The invention also pertains to a dispenser for discharging flowable compounds such as liquid or pasty compounds, wherein said dispenser comprises a reservoir for accommodating the compound and a dispensing pump with a modular design, wherein the dispenser has a longitudinal axis, wherein the dispensing pump furthermore has an inflow channel and an outflow channel and a pumping chamber, which is delimited by valves on the inflow side and the outflow side, as well as a head piece, wherein the head piece has a dispensing opening, wherein the dispensing pump furthermore can be inserted into the reservoir and in the process connected to the reservoir by means of a snap-fit connection, wherein the pumping chamber furthermore is formed by a piston and a cup part, which has a cup bottom and a cup wall, wherein the piston is accommodated in the cup part in a slidable manner in order to achieve a pumping stroke, wherein the cup part furthermore has on its outer wall fastening formations for fastening interaction with an inner wall of the reservoir, wherein the cup part with the fastening formations is in addition realized in an exchangeable manner in order to be adapted to different reservoirs, wherein a restoring device arranged between the piston and the cup part and limiting devices for limiting a restoring motion furthermore are provided, wherein said limiting devices come in contact with one another at a maximum pumping chamber volume, wherein the head part furthermore can be attached to the dispensing pump in an exchangeable manner and has a dispensing opening and a dispensing channel, wherein the dispensing channel can be inserted into the outflow channel of the dispensing pump, and wherein an insertion depth of the dispensing pump into the reservoir furthermore is so large that a lower edge of the dispensing pump with its inflow channel is in direct contact with the compound to be dispensed.

PRIOR ART

A dispenser for discharging flowable compounds such as liquid or pasty compounds initially is known, for example, from EP 1 015 340 B1. The modular and exchangeable design results in a compact dispensing pump, which can be used in a plurality of dispensers that can be designed freely with respect to their head piece and storage container. With respect to dispensers of this type, we furthermore refer to DE 20 2008 011 730 U1. The latter publication concerns a dispenser with a closure part that is slot-guided on a stationary dispensing part and proposes to realize an obtuse angle between a longitudinal axis of the slotted guide and a longitudinal axis of the closure part in order to thereby adjust a desired motion characteristic with respect to different angles of different parts.

EP 1 460 001 A1 discloses a dispenser with a pumping chamber and a head piece, in which a variable distance can be adjusted between the head piece and an upper exposed surface of a connecting part with the reservoir, wherein a depression of the head piece always takes place from the same extension height. JP 3 068 498 U discloses a dispenser of this type, in which a blocking part consisting of an elastic material can be clipped on an exposed connecting tube leading from the pumping chamber to the pumping head from outside. When the blocking part is clipped on, the pumping head can only be moved downward by a shorter distance from the otherwise identical extension height.

DE 10 2007 007 402 A1 discloses a dispenser, in which a precision adjustment of a pumping stroke can be realized, wherein the extension height of the head piece is also preserved when the pumping stroke is changed. The limiting device acts between a wall and a cap ceiling of a protective cap of the dispenser. DE 297 17 036 discloses a dispenser, in which a variable limiting device acts between a rotary actuating sleeve and an external profile section.

SUMMARY OF THE INVENTION

Based on the above-described prior art, the invention aims to disclose a dispenser for discharging flowable compounds such as liquid or pasty compounds, in which a dispensing pump can be advantageously adjusted with respect to different discharge quantities.

This objective is initially attained with, a dispenser for discharging flowable compounds such as liquid or pasty compounds, having a reservoir for accommodating the compound and a dispensing pump, wherein the dispenser has a longitudinal axis (x), wherein the dispensing pump has an inflow channel and an outflow channel and a pumping chamber, which is delimited by valves on the inflow side and the outflow side, as well as a head piece. The head piece has a dispensing opening, and a pumping part can be moved relative to a cup part against an elastic force of a restoring device in order to achieve a pumping stroke. The head piece is motion-coupled with the pumping part such that a motion of the head piece from a completely depressed position to an attainable extension height corresponds to the pumping stroke. A variable limiting device is provided for variably limiting the pumping stroke and a change of the pumping stroke corresponds to a change of the extension height. The cup part has a cup bottom and a cup wall, wherein the cup bottom delimits the reservoir toward the dispensing pump and the cup wall stands on the cup bottom on the side of the head part and optionally serves for producing a snap-fit connection with the reservoir. The limiting device acts between the cup bottom, optionally on an exchange part that is connected to the cup bottom, or the cup wall and the head piece and/or that the limiting device consists of exchange parts, which can be used selectively in order to realize a desired pumping stroke and have different dimensions in order to realize different pumping strokes.

This objective is also attained with a dispenser in which it is proposed that a variable limiting device is provided for variably limiting the pumping stroke.

Alternatively or additionally to the provision that a change of the pumping stroke corresponds to a change of the extension height, it would also be possible that the restoring device repositions the head piece during a change of the pumping stroke from a smaller pumping stroke to a greater pumping stroke.

If an adjusting device such as a screw-type adjusting device is provided, the head piece can during an adjustment to a greater stroke readily and automatically reposition itself into the additionally extended position, which then represents the starting position for a subsequent pumping process, as a result of the elastic restoring device. The same effect is also achieved, for example, if a greater pumping stroke is merely adjusted by means of an exchange part.

The utilization of the limiting device makes it possible to adjust the pumping stroke of the piston in the cup part in general and therefore the quantity of the compound to be discharged through the dispensing opening in the course of a pumping actuation. This makes it possible to limit the pumping stroke between a minimally possible pumping stroke, which in a potential embodiment of the limiting device may also be equal to zero, and a maximally possible pumping stroke, which particularly is defined by the above-described limiting device. The dispenser as such basically is designed in such a way that the piston can reach a certain predefined pumping stroke. The limiting device serves for limiting this maximally possible pumping stroke in an optionally variable manner.

The cup part preferably has a cup bottom and a cup wall. The cup wall preferably extends on the side of the head part starting from the cup bottom. The cup bottom can delimit the reservoir toward the dispensing pump. The limiting device acts between the cup bottom or the cup wall and the head piece. An additional part, namely an exchange part, may be connected to the cup bottom in this case.

It is preferred that the mobility of the piston relative to the cup part is respectively stop-limited—with respect to a standing position of the dispenser on a surface, in which the longitudinal axis of the dispenser is oriented perpendicular to the surface—between a lowermost piston position and an uppermost piston position, which is shifted relative to the lowermost piston position in the axial direction, by means of the limiting devices. These limiting devices or at least one of these limiting devices can be changed in order to change the possible displacement travel of the piston along the axis and therefore to change the maximally possible pumping stroke.

According to an embodiment, the limiting device that restricts the pumping stroke and optionally can be assigned or adjusted separately may only allow a stroke limitation at all due to a corresponding assignment. Alternatively, such a variable limiting device is provided in addition to a device that generally limits a maximally possible pumping stroke. The variable limiting means makes it possible to reduce the pumping stroke in comparison with the maximum pumping stroke defined by the generally existing limiting device.

As a result of the above-described design, the dispenser already can be provided with differently adjusted or differently designed limiting devices for limiting the pumping stroke, for example, at the factory. A basically variable limiting device may also be provided in order to enable the user to optionally change the pumping stroke.

According to another potential embodiment, a variable limiting device furthermore can be used as a transport safety device of the dispenser, particularly in an embodiment, in which a pumping stroke is prevented.

Other characteristics of the invention are frequently described below, as well as in the description of the figures, in their preferred association with the object of claim 1 or with characteristics of other claims. However, they may also be important in association with only individual characteristics of claim 1 or the respective other claim or independently.

The limiting device may furthermore consist of exchange parts that can be used selectively in order to realize a desired pumping stroke and have different dimensions in order to realize different pumping strokes.

An adapted limiting device can be inserted or attached in the form of an exchange part in order to achieve a desired pumping stroke corresponding to a desired maximum displacement of the piston along the longitudinal axis. For example, a limiting device in the form of an exchange part may represent a transport safety device of the dispenser, particularly the dispenser head, wherein a corresponding limiting device does not allow a pumping stroke and preferably holds the piston in its lowermost and preferably stop-limited position.

Furthermore, additional limiting devices in the form of exchange parts may be provided and used, for example, instead of the above-described limiting device representing a transport safety device, wherein said additional limiting devices allow a pumping stroke amounting to 0.25-times or 0.5-times, furthermore 0.75-times, the maximum pumping stroke. In this respect, any other limiting value between zero and the maximum stroke can also be adjusted by means of corresponding limiting devices.

The limiting devices can be fixed, for example, on the cup part of the dispenser in the form of exchange parts, e.g. as a result of a screw connection or a snap-fit connection.

In a potential embodiment, the limiting device may directly interact with the dispenser head in a stop-limiting manner, wherein said dispenser head interacts with the piston and the piston part in order to be jointly displaced. In another exemplary embodiment, the limiting device may accordingly also directly interact with the piston or the piston part. Each exchange part defines a possible pumping stroke.

The limiting device may also consist of an adjusting part. This adjusting part may form a component of the dispenser that, in particular, cannot be removed without tools and without being destroyed. The adjusting part allows in a first adjustment position a greater pumping stroke than in a second adjustment position. In a preferred embodiment, the adjusting part accordingly is designed for arranging the element, which essentially acts as limiting device, differently along the longitudinal axis of the dispenser. Consequently, different pumping strokes can be adjusted with only one adjusting part.

In a potential embodiment, the adjustability of the adjusting part may only be possible at the factory during the configuration of the dispenser or the dispenser head, wherein a subsequently adjusted position of the adjusting part can in a manner of speaking be frozen, e.g. as a result of a corresponding snap-fit connection, an adhesive connection or optionally also a partial welded connection with a section of the dispenser head or the cup part, which cannot be displaced relative to the adjusting part.

According to a potential embodiment, the adjusting part furthermore may be adjustable by the user during daily use in order to thereby allow different pumping strokes as needed, wherein the adjusting part can also be adjusted to such a degree that a pumping stroke is prevented, e.g. in order to realize a transport safety device.

In a potential embodiment, the adjusting part may be realized such that it can merely be displaced along the longitudinal axis in a sliding manner. In another exemplary embodiment, multiple fixing stages may be provided over the maximally possible sliding displacement travel, e.g. by forming a snap-fit connection.

In a preferred embodiment, the adjusting part can be adjusted as a result of a screw thread, wherein the adjusting part is moved along the longitudinal axis with its section, which essentially influences the pumping stroke limitation, as a result of a screwing motion. This section ultimately interacts with a mating stop, particularly of the dispenser head.

The adjusting part may interact directly with the dispenser head or with a section of the piston or piston part, which is movably connected to the dispenser head. Alternatively, the adjusting part may also interact with a stopping part that is linearly guided on the adjusting part in the direction of the longitudinal axis of the dispenser. As a result of this linear guide, a rotational motion of the adjusting part or the dispenser about the longitudinal axis can lead to a linear displacement of the stopping part along the longitudinal axis. This preferably also allows an adjustment of the pumping stroke between a transport safety position and a maximum stroke.

In this case, the stopping part may interact with the head part in a threaded manner, wherein an external thread of the stopping part, which points radially inward, engages according to a potential embodiment into a correspondingly adapted internal thread of the head part. Alternatively, a pin or the like of the stopping part, which protrudes radially inward, may also engage into the internal thread of the head part.

In another embodiment, the head piece may be rotationally coupled with the adjusting part such that a change of the possible pumping stroke can be achieved by taking hold of and rotating the exposed head piece relative to the reservoir.

To this end, the adjusting part may interact with the cup part in a threaded manner. In this way, a rotation of the head piece about the longitudinal axis can lead to a superimposed displacement of the adjusting part along the longitudinal axis in order to change the stop for the head piece and to thereby change the pumping stroke. It is preferred that only the adjusting part is subjected to a (superimposed) linear displacement in order to change the pumping stroke. In such an embodiment, the head piece preferably remains stationary in the linear direction along the longitudinal axis in the course of the change of the pumping stroke such that no compound discharge takes place during such a mere change of the orientation of the limiting device.

BRIEF DESCRIPTION OF THE DRAWINGS

The invention is described in greater detail below with reference to the attached drawings that, however, merely show exemplary embodiments. A component, which is described with reference to one of the exemplary embodiments and not replaced with a different component in another exemplary embodiment, is therefore also described as a potentially existing component in this other exemplary embodiment. In the respective drawings.

DESCRIPTION OF THE EMBODIMENTS

Figure 1:
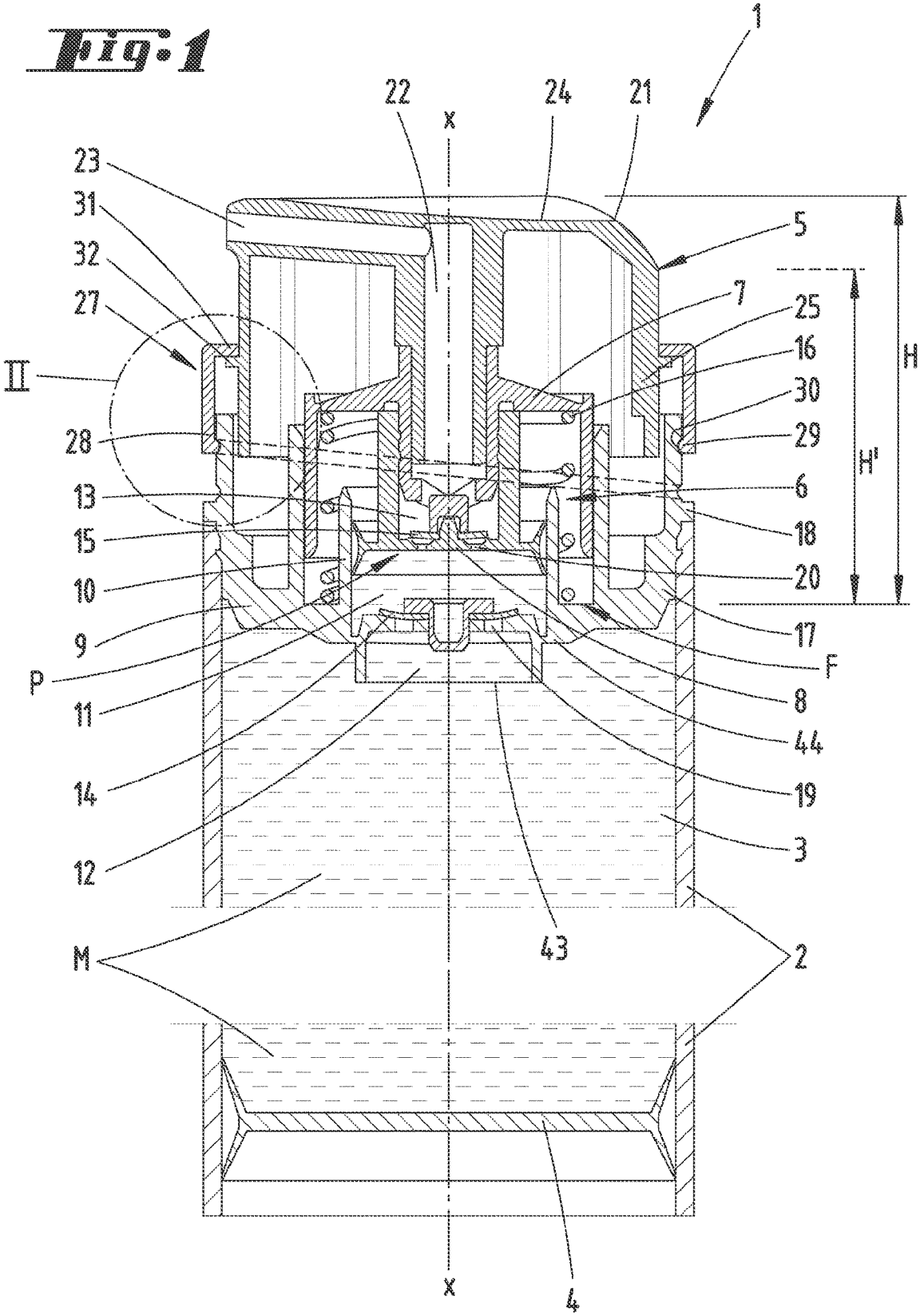
FIG. 1 shows a longitudinal section through a dispenser concerning a first position of a variable limiting device according to a first embodiment.

A dispenser 1 for being arranged on a reservoir 2 is initially described with reference to FIG. 1.

In the exemplary embodiments shown, the reservoir 2 preferably is realized in the form of an essentially cylindrical body with an optionally central longitudinal axis x, which in the correspondingly associated position also extends through the dispenser 1, preferably in the form of a rotational axis.

The reservoir 2 may have a storage chamber 3 for accommodating a compound M to be dispensed. This storage chamber 3 may be delimited on its bottom side by a follower piston 4.

The dispenser 1 can be inserted into the opening of the reservoir 2, which points upward in a normal standing state of the reservoir 2, and fastened on the reservoir 2.

The dispenser 1 essentially is composed of a head piece 5 and a dispensing pump 6.

The dispensing pump 6 has a pumping part P, which in this case preferably is realized in the form of a piston body 7 with a piston 8, as well as a cup part 9 with a cup bottom 44 and preferably a cylinder section 10. In this case, the piston 8 is accommodated in the cylinder section 10 such that it can be moved along the longitudinal axis x in a sliding manner, wherein a pumping chamber 11 is formed between the piston 8 and the cylinder section 10 and furthermore delimited by the cup bottom 44 of the cup part 9.

The cup part 9 preferably is realized in an exchangeable manner in order to be adapted to different reservoirs 2, particularly different opening diameters and/or opening cross sections of the reservoir 2.

The pumping chamber 11 connects an inflow channel 12 and an outflow channel 13, wherein both channels can be respectively separated from the pumping chamber 11 by a valve 14 on the inflow side and a valve 15 of the outflow side.

The two valves 14 and 15 preferably are realized in the form of check valves and installed in such a way that they open in the same direction, i.e. in the dispensing direction.

A restoring device 16, which in this case preferably is realized in the form of a cylindrical spring and exerts an elastic force, is arranged between the piston part 7 and the cylinder section 10. This spring may conventionally consist of a metallic cylindrical spring. Alternatively, a spring that is made of an elastically resilient plastic material may also be provided in order to realize an all-plastic dispenser.

It is furthermore preferred to arrange the restoring device 16 such that it is on one end supported on the cup bottom 44 in preferably concentric arrangement to the longitudinal axis x and on the other end acts against the head piece 5, in this case preferably an upper end wall of the piston part 7, namely in such a way that the head piece 5 with the piston part 7 and the piston 8 is acted upon in the direction of a pumping chamber enlargement in order to once again fill the pumping chamber 11 after carrying out a pumping stroke, during which the pumping chamber volume is reduced.

The piston part 7 and the cup part 9 respectively are realized in an essentially cup-shaped manner. They may be engaged with one another and jointly delimit the dispensing pump 6 outward such that a capsule-like housing is formed. At least one fastening projection 28, which may also be realized, for example, in the form of an annular projection, may be provided on a radial cup wall 17 of the cup part 9. This fastening projection 18 can serve for fixing the position of the dispensing pump 6 in the installed state between the head piece 5 and the reservoir 2.

The head piece 5 has an extension height H in the non-actuated state as it is consistently illustrated in the figures. This extension height H may be measured, for example, from a lower stopping surface F for the piston part 7 in the depressed state. A change of the limiting device for limiting the pumping stroke b accordingly results in a reduced extension height H' as it is illustrated, for example, in FIG. 1. A change of the pumping stroke b therefore readily corresponds to a change of the extension height H.

Figure 24B:
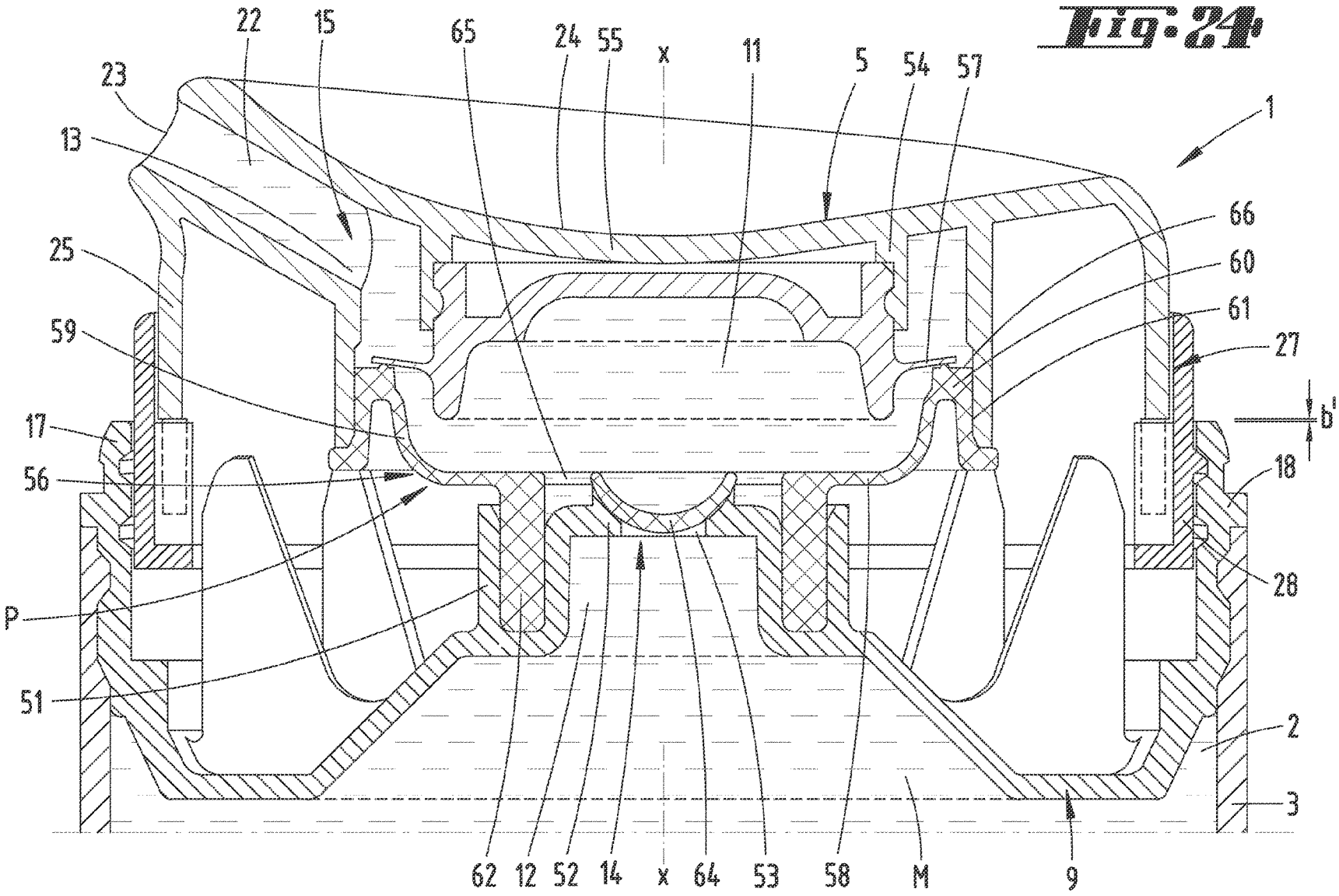
FIG. 24 shows the embodiment according to FIG. 23 with orientation of the limiting device in a second position.

The restoring device 16 repositions the head piece 5, particularly when the pumping stroke b is changed from a smaller pumping stroke b to a greater pumping stroke b, due to the elastic design of the restoring device 16, e.g. the aforementioned cylindrical spring illustrated in a few of the embodiments, but also due to the elastic delimiting wall 59, e.g. in the embodiment according to FIG. 24. The repositioning practically is caused directly by the elastic force of pressure exerted, e.g., by the aforementioned cylindrical spring or the membrane 50. Accordingly, the extension height H is automatically increased in this case.

It is furthermore apparent that the limiting device 27 acts between the cup part 9 and the head piece 5. In the embodiment according to FIG. 1, as well as in the embodiment according to FIG. 7 or FIG. 12, the action takes place between a cup wall 17 and the head part 5. In the embodiment according to FIG. 13, the action specifically takes place between an exchange part 37 connected to a cup bottom 44 and the head piece 5, wherein the exchange part 37 may be arranged on an upwardly protruding cylinder section of the cup bottom as shown. In the embodiment according to FIG. 16, for example, the limiting device 27 acts between an inner surface of the outer cup wall and a stopping surface for the head piece formed on the adjusting part guided thereon as described in greater detail further below.

A comparable solution is also realized, e.g., in the embodiment according to FIG. 20 as described in greater detail further below.

In the exemplary embodiments shown, the valves 14 and 15 are realized in the form of so-called annular gap valves with an annular valve body, which respectively covers a respective annular gap 19 or 20 of the respective inflow or outflow channel 12, 13.

A homogenous dispensing behavior is achieved due to the radially symmetrical design of the dispensing pump 6. However, the dispensing pump is not limited to radially symmetrical designs, but rather may also have an arbitrary cross-sectional shape, e.g. a square or polygonal shape. Other known check valves such as flap valves may also be used instead of the annular gap valves shown.

Furthermore, the piston may be realized integrally with the piston part 7. A kinematic reversion of the dispensing pump 6 with a reversal of the opening direction of the check valves is also possible.

The dispensing pump 3 is adjoined by the head piece 5 that has a dome-like actuating part 21 with a dispensing channel 22 and a dispensing opening 23, as well as an actuating surface 24, which preferably is formed on its upper side and directed transverse to the longitudinal axis x, and an actuating part wall 25, which extends circumferentially and optionally is arranged concentric to the longitudinal axis x.

On its outer wall, the actuating part 21 preferably is guided in the axial direction circumferentially by the cup wall 17 of the cup part 9 with the aid of its actuating part wall 25.

With respect to a cross-sectional view, in which the longitudinal axis x is illustrated in the form of a line such as in FIG. 1, the dispensing channel 22, which in the exemplary embodiment shown initially accommodates the longitudinal axis x along its longitudinal extent centrally, extends outward under inclusion of a preferably obtuse angle to the longitudinal axis x and leads into the dispensing opening 23. In this case, the dispensing channel 22 is inserted into the outflow channel 13 in a sealing manner, wherein the piston 8, the piston part 7 and the dispensing channel 22 including the actuating part 21 furthermore interact in the usage position in order to be jointly displaced along the longitudinal axis x. The entire head piece 5 with the piston 8 fixed thereon accordingly is supported by means of the restoring device 16.

When the dispensing pump 6 or the dispenser 1 as a whole is inserted into the reservoir 2, a lower edge 43 of the dispensing pump 6 penetrates with its inflow channel 12 into the reservoir 2 and therefore into the compound M stored therein to such a depth that direct contact with the compound M to be dispensed is produced. When the dispenser 1 is attached to the reservoir 2, the compound M therefore preferably can spread out as far as into the pumping chamber 11 through the inflow valve 14, which in the course of the attachment opens as a result of pressure application, in order to initially fill said pumping chamber.

Figure 4:
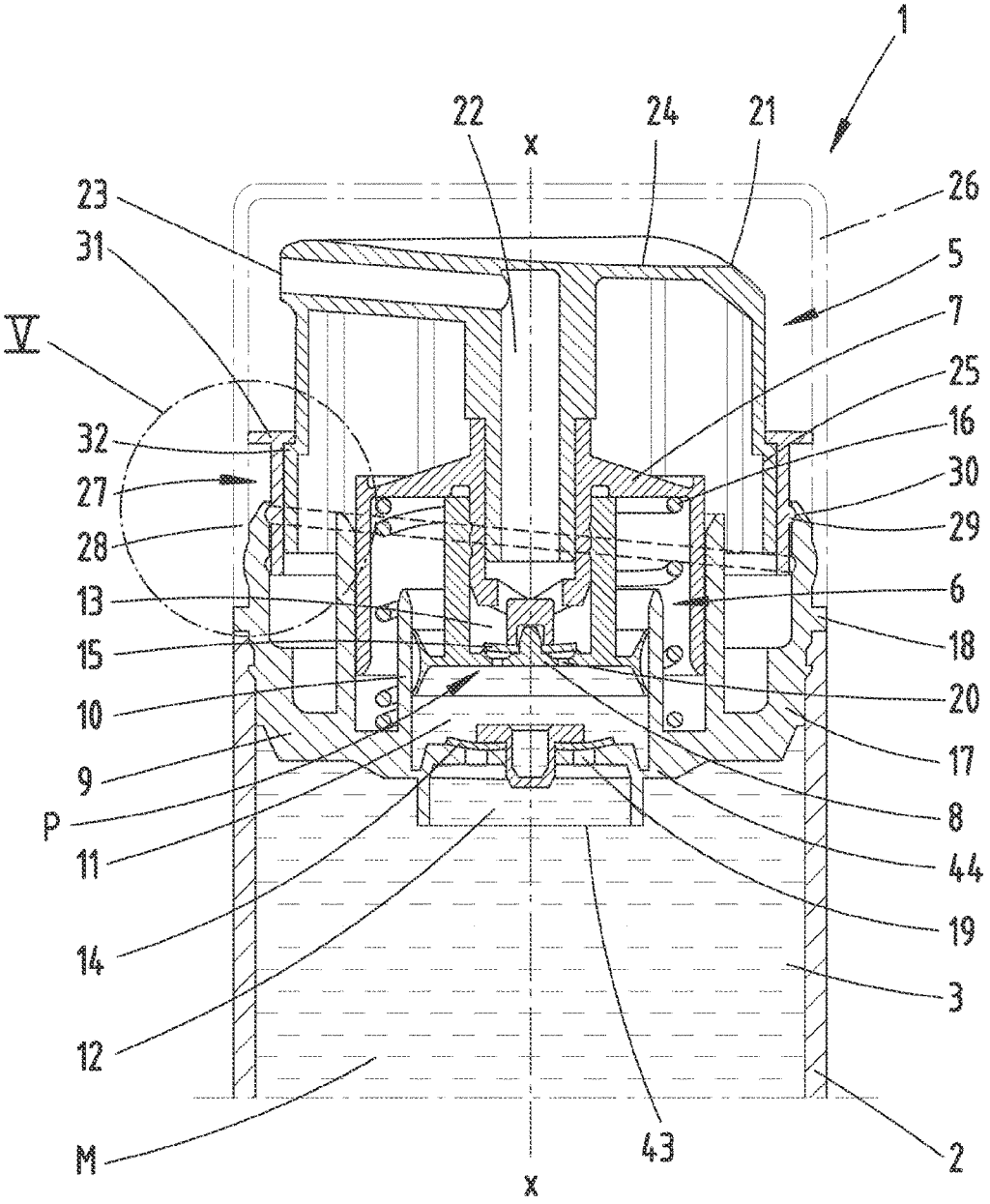
FIG. 4 shows a representation corresponding to FIG. 1 and concerning a second embodiment.

FIG. 4 furthermore shows that the dispenser 1, particularly the head piece 5, may be covered by a cap 26 in the non-usage position. In this case, the cap is fixed in the region of the cup wall 17 in a snap-fitted manner, optionally and preferably while being axially supported on the fastening projection 18.

In addition, a limiting device 27 is provided for limiting the axial displaceability of the head piece 5 including the piston 8, particularly into a distant position referred to the cup part 9. The limiting position shown, for example, in FIGS. 1 and 2 is the maximum filling position of the pumping chamber 11.

A limitation of the displaceability, which defines the lowermost piston position and therefore the smallest pumping chamber volume, preferably is also provided in the opposite direction for a corresponding pressure actuation and downward motion of the head piece 5 in the direction of the cup part 9.

The limiting device 27 of all embodiments illustrated in the drawings can be changed in order to variably limit the respectively resulting pumping stroke b, particularly with respect to limiting the motion of the head piece 12 with the piston 8 in the relaxing direction of the restoring device 16 and therefore in the direction of a thusly defined maximum pumping chamber volume. The lowering motion of the head piece 5 in the course of a discharge of the compound M through the dispensing opening 23 may alternatively or additionally also be variable with respect to its limitation, wherein the usable pumping chamber volume can thereby also be changed between the two defined end positions of the piston 8 in the pumping chamber 11.

Figure 2:
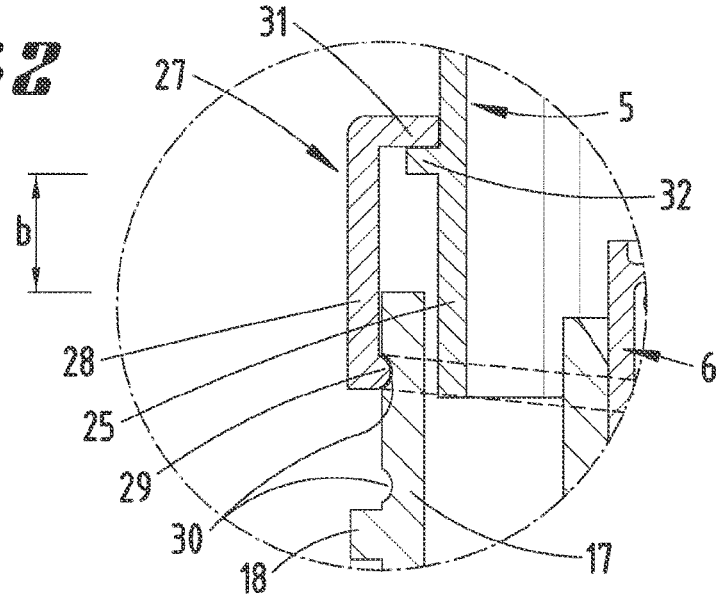
FIG. 2 shows an enlarged detail of the region II in FIG. 1.
Figure 3:
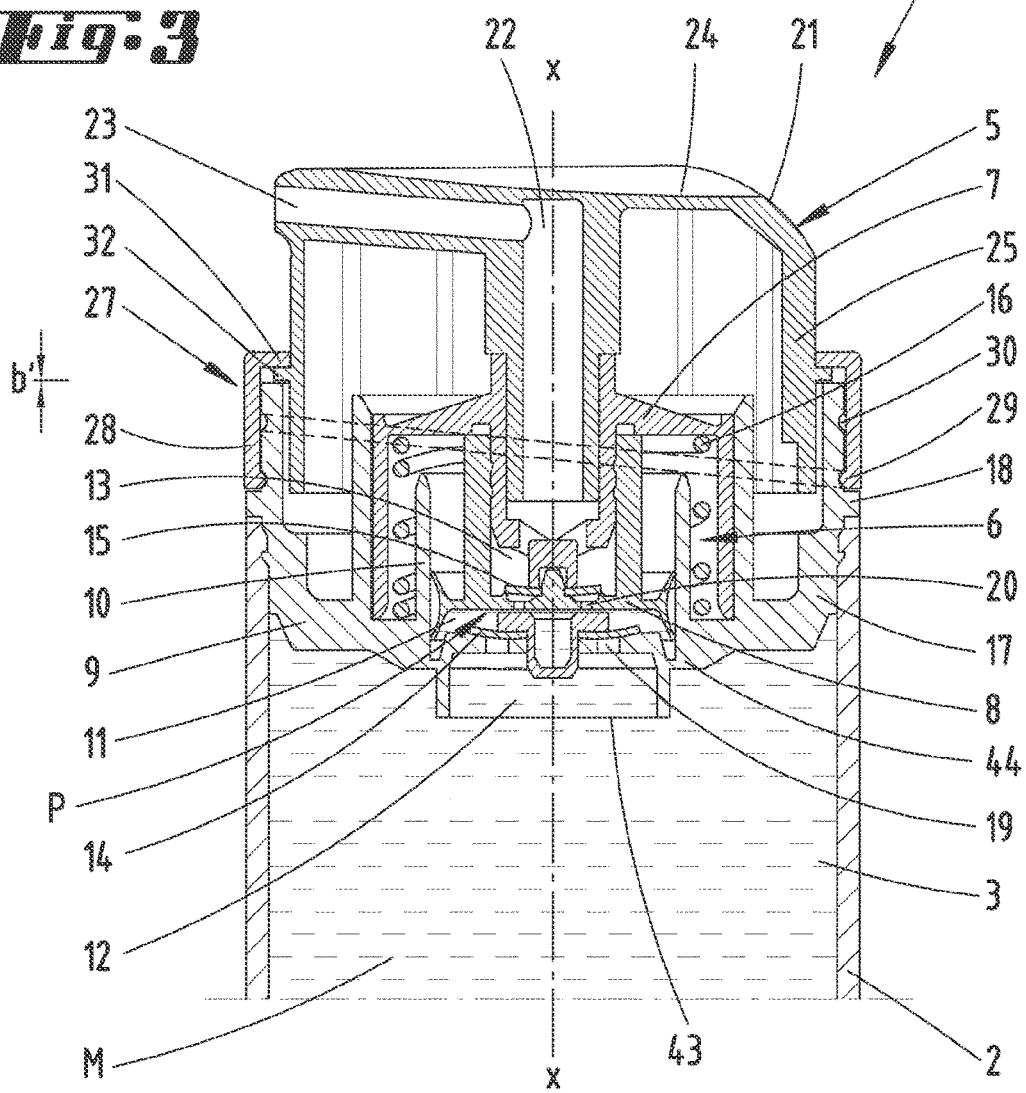
FIG. 3 shows a representation corresponding to FIG. 1, but concerning a second position of the variable limiting device.

To this end, the limiting device 27 initially may consist of an adjusting part 28, which according to the first embodiment illustrated in FIGS. 1 to 3 interacts with the head piece 5 on the outer side of the cup wall 17, preferably above the fastening projection 18. The adjusting part 28 essentially is realized annularly, preferably concentric to the longitudinal axis x, and has an external thread 29, which points radially inward and serves for interacting with an internal thread that points radially outward in the region of the cup wall 17. The internal thread 30 may be realized, for example, in the form of a two-stage thread.

The adjusting part 28 protrudes beyond the upwardly directed edge section of the cup part 9 and forms a collar 31, which protrudes radially inward, in the region of its free end. This collar encloses the actuating part wall 25 of the head piece 5 and rests on a supporting collar 32, which is integrally formed on the actuating part wall 25 and protrudes radially outward.

The normal position according to FIG. 1, which corresponds to the intake position of the compound M into the pumping chamber 11, therefore is stop-limited in the relaxing direction of the restoring device 16 due to the abutment of the supporting collar 32 on the underside of the collar 31.

According to FIGS. 1 and 2, this results in a pumping stroke b that is defined by the free travel of the supporting collar 32 between the collar 31 of the adjusting part 28 and the facing annular end face of the cup wall 17.

FIG. 3 shows a changed position of the adjusting part 28, in which the adjusting part 28 is rotated about the longitudinal axis x, wherein this causes the adjusting part 28 to be lowered in the direction of the fastening projection 18 of the cup part 9 as a result of the above-described thread engagement. FIG. 3 shows a position of the adjusting part 28, in which the adjusting part 28 is moved into a lowermost position that corresponds to the transport position of the head piece 5. The supporting collar 32 is constrained between the collar 31 of the adjusting part 28 and the cup wall 17. In this case, the pumping stroke b' approximately corresponds to zero such that the adjusting part 28 can in this position be used as a transport safety device of the dispenser 1.

The adjusting part 28 can assume any intermediate position between the positions of the adjusting part 28 illustrated in FIGS. 2 and 3 in order to change the pumping stroke b between a pumping stroke corresponding to zero and a maximum pumping stroke. For example, the adjusting part 28 can be snap-locked in different rotational positions in order to thereby fix the adjusted pumping stroke.

Figure 5:
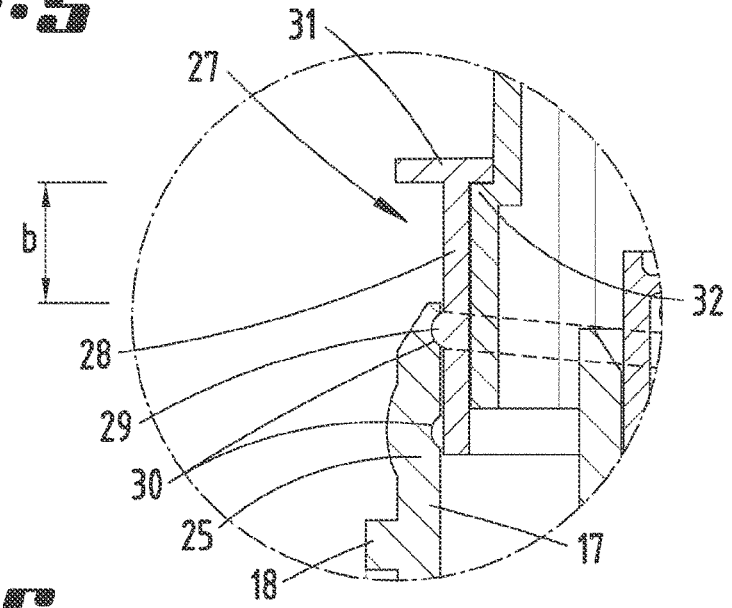
FIG. 5 shows an enlarged detail of the region V in FIG. 4.
Figure 6:
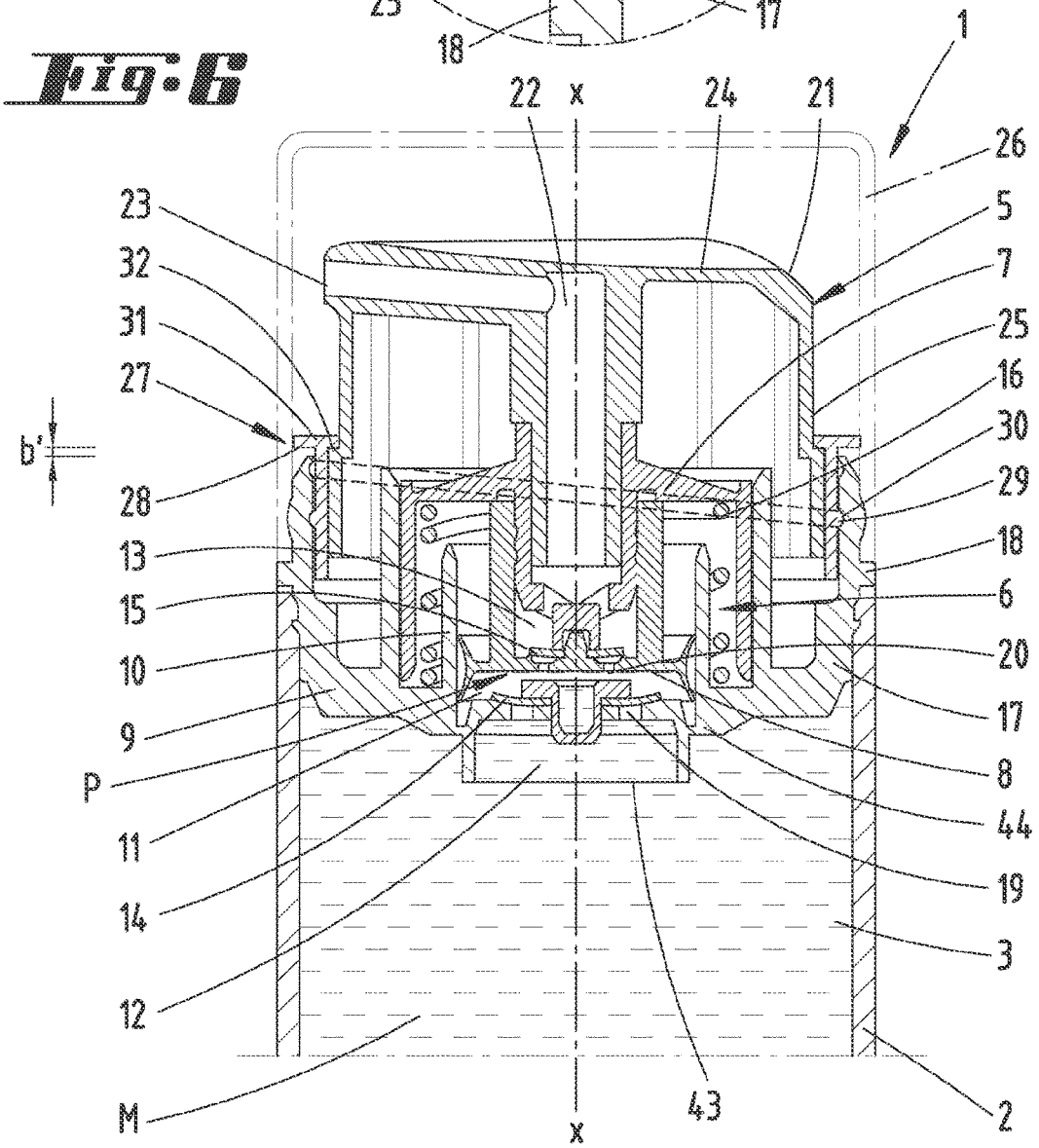
FIG. 6 shows the dispenser according to FIG. 4 in a second position of the limiting device.

In the alternative embodiment illustrated in FIGS. 4 to 6, the adjusting part 28 may also be arranged on the inner side of the cup wall 17 between this cup wall 17 and the actuating part wall 25. The thread arrangement accordingly is provided on the inner side with respect to the cup part 9. The function for changing the pumping stroke b' corresponds to that of the first exemplary embodiment, wherein the pumping stroke b' adjusted in FIG. 6 is greater than zero, but smaller than the pumping stroke b according to the position in FIGS. 4 and 5.

Figure 7:
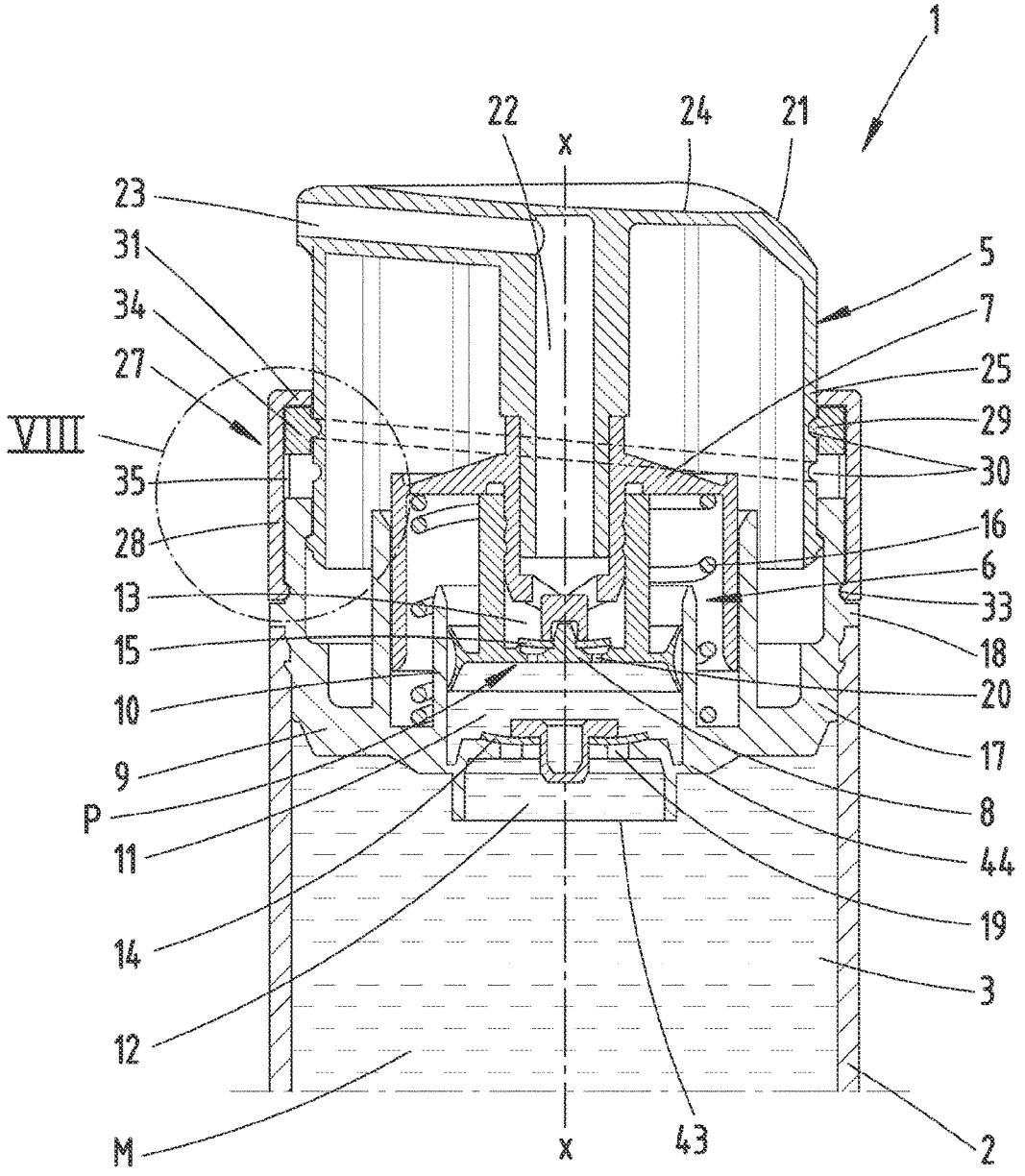
FIG. 7 shows another representation corresponding to FIG. 1 and concerning a third embodiment.
Figure 8:
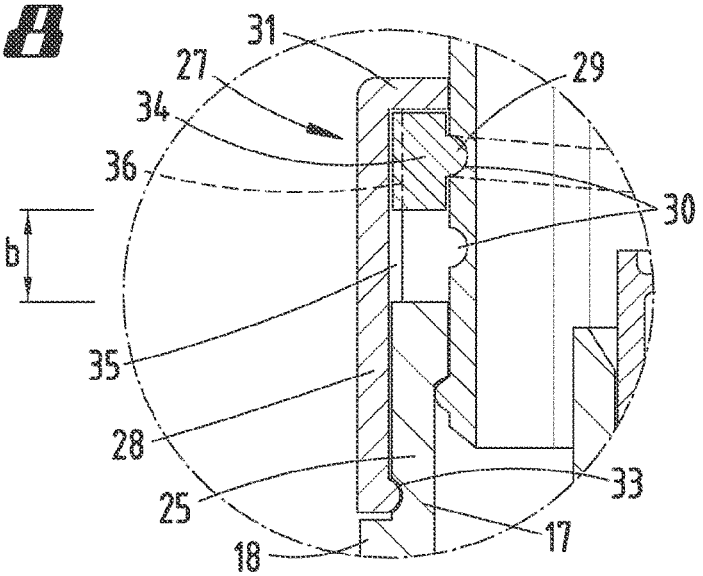
FIG. 8 shows an enlarged detail of the region VIII in FIG. 7.
Figure 9:
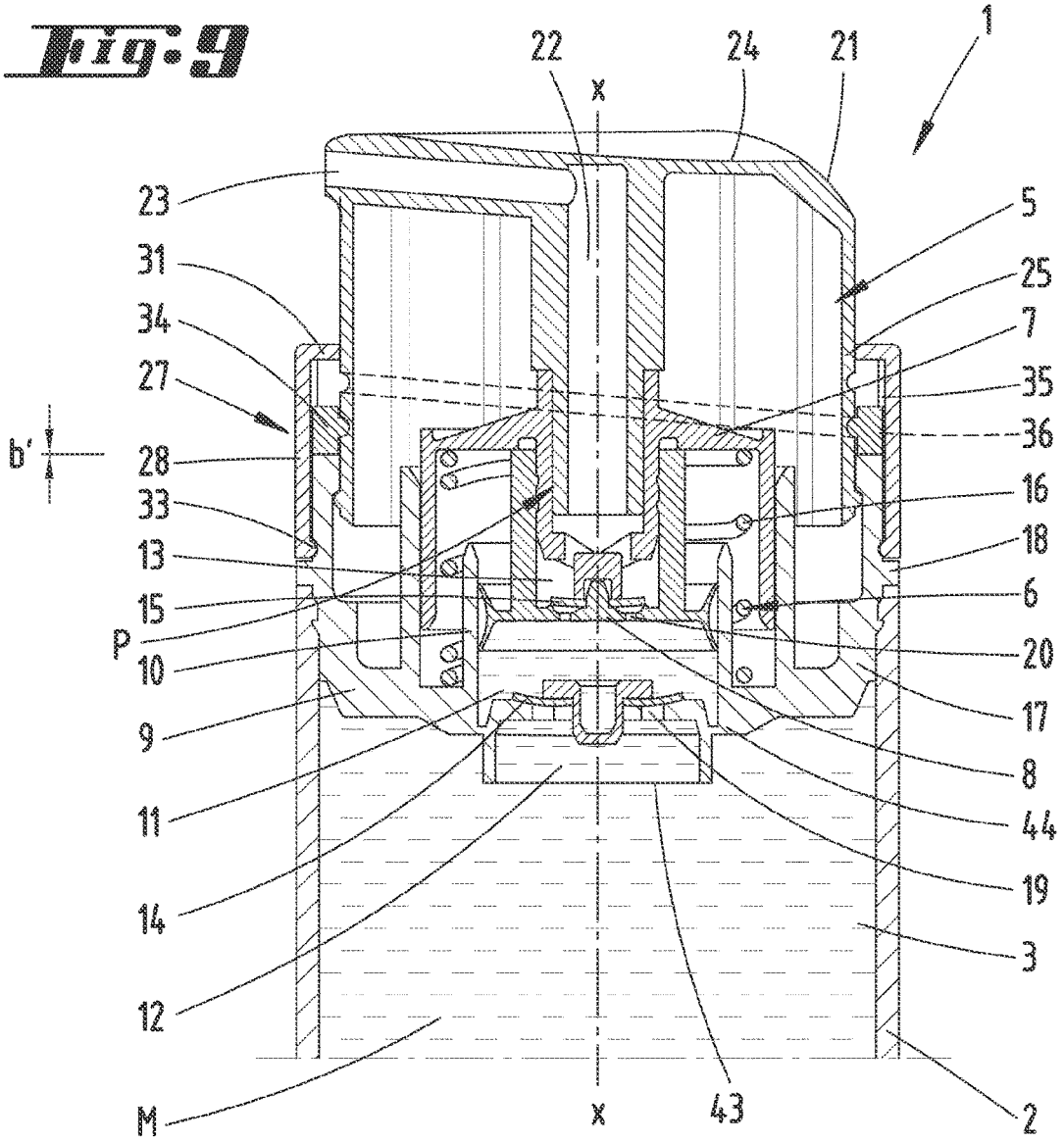
FIG. 9 shows the dispenser according to FIG. 7 with a changed limiting device.

According to the illustrations in FIGS. 7 to 9, an adjusting part 28 may also be arranged in an annular groove 33 provided on the outer side of the cup wall 12 such that it is rotatable about the longitudinal axis x. In this embodiment, a stopping part 34 is arranged in the annular space resulting between the end face of the cup wall 17 and the lower surface of the collar 31 of the adjusting part and the adjusting part wall. According to the illustrations, this stopping part essentially may be formed such that it extends annularly about the longitudinal axis x. Furthermore, one or more stopping parts 34 may also be distributed over the circumference.

The stopping part 34 is linearly guided on the adjusting part 28 in the direction of the longitudinal axis x, wherein a guide web 35 extending in the direction of the longitudinal axis x is to this end integrally formed on the inner wall of the adjusting part 28 in the embodiment shown. This guide web engages into a correspondingly shaped guide groove 36 of the stopping part 34 (compare, in particular, to FIG. 8). This configuration could also be reversed such that a web of the stopping part is guided in a groove of the adjusting part.

In an annular design, the stopping part 34 is provided with an external thread 29 that protrudes radially inward. If a plurality of stopping parts 34 are distributed over the circumference, these stopping parts may alternatively have projections that protrude radially inward.

The external thread 29 or the projections engage into an internal thread 30 that is recessed into the outer side of the actuating part wall 25.

Due to the thread engagement, a preferably manual rotation of the adjusting part 28 about the longitudinal axis x accordingly causes the stopping part 34 to be linearly dragged along such that a change of the pumping stroke b can also be achieved as a result of this design.

According to this embodiment, a maximum pumping stroke b is also adjusted by means of the adjusting part 28 in FIGS. 7 and 8 and a minimum pumping stroke b', which analogous to the first exemplary embodiment may be approximately equal to zero, is adjusted in FIG. 9 such that, for example, a transport safety device can also be realized by utilizing this embodiment.

It is also possible to adjust any intermediate position and therefore any pumping stroke between the maximum pumping stroke according to FIGS. 7 and 8 and the pumping stroke corresponding to zero according to FIG. 9.

FIGS. 10 to 15 show two embodiments, in which the change of the limiting device 17 can be realized by means of exchange parts 37.

Figure 10:
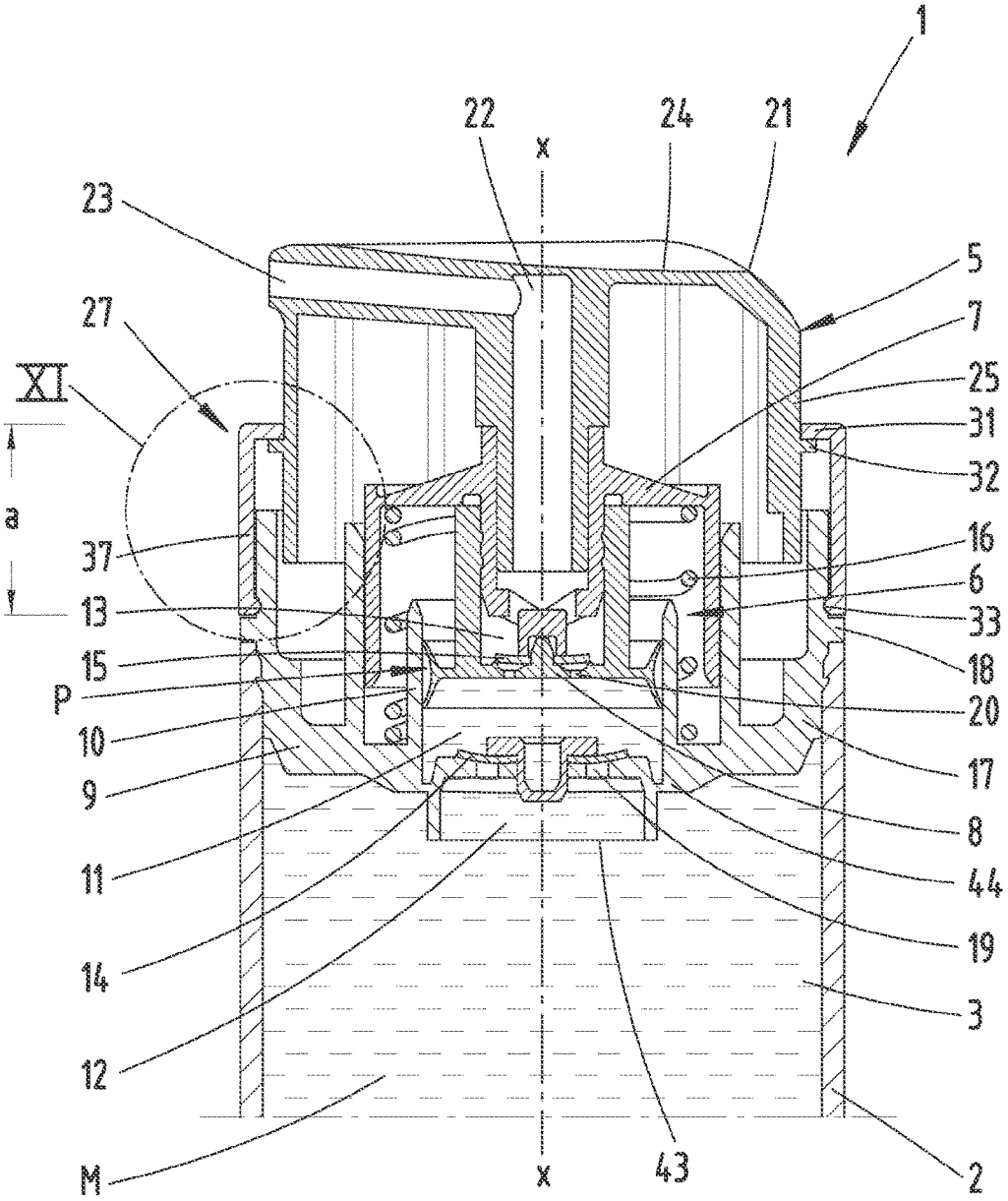
FIG. 10 shows a fourth embodiment in the form of a representation according to FIG. 1.
Figure 11:
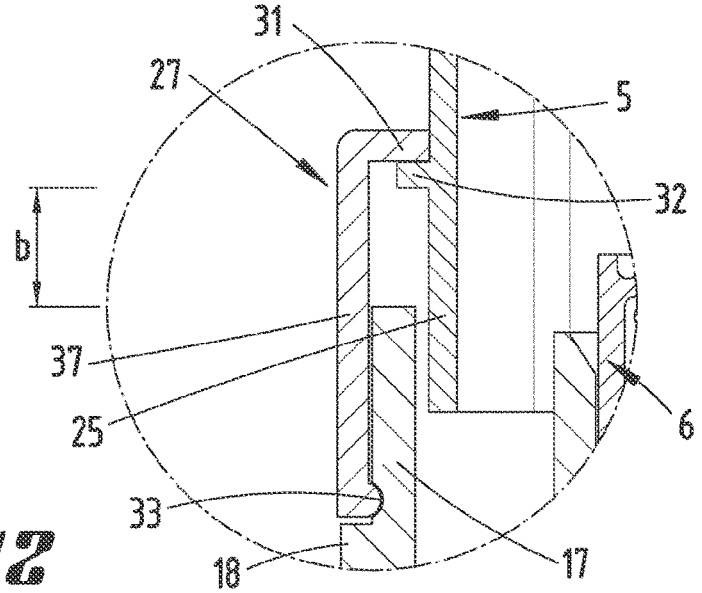
FIG. 11 shows an enlarged detail of the region XI in FIG. 10.
Figure 12:
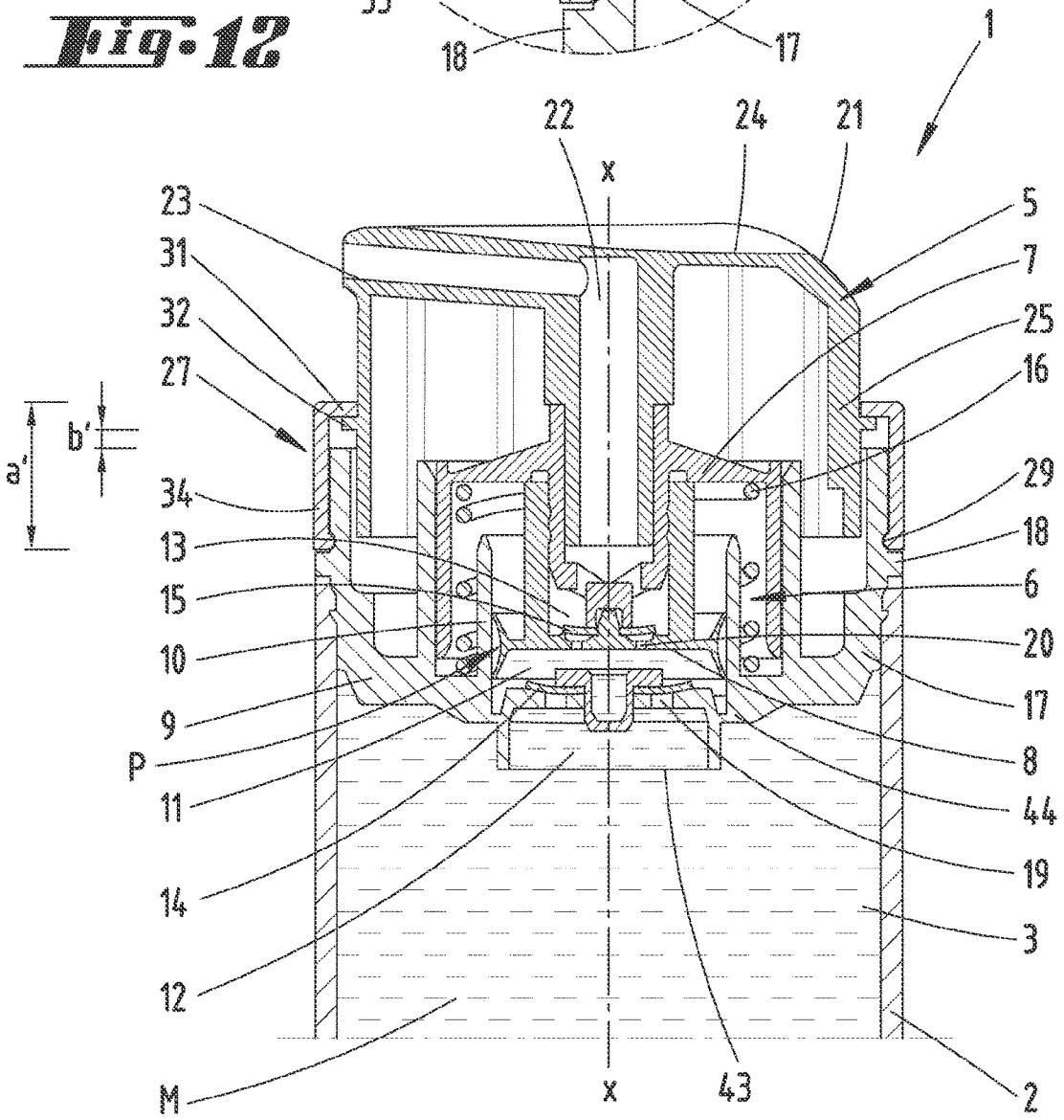
FIG. 12 shows the dispenser according to FIG. 10 in a changed position of the limiting device.
Figure 13:
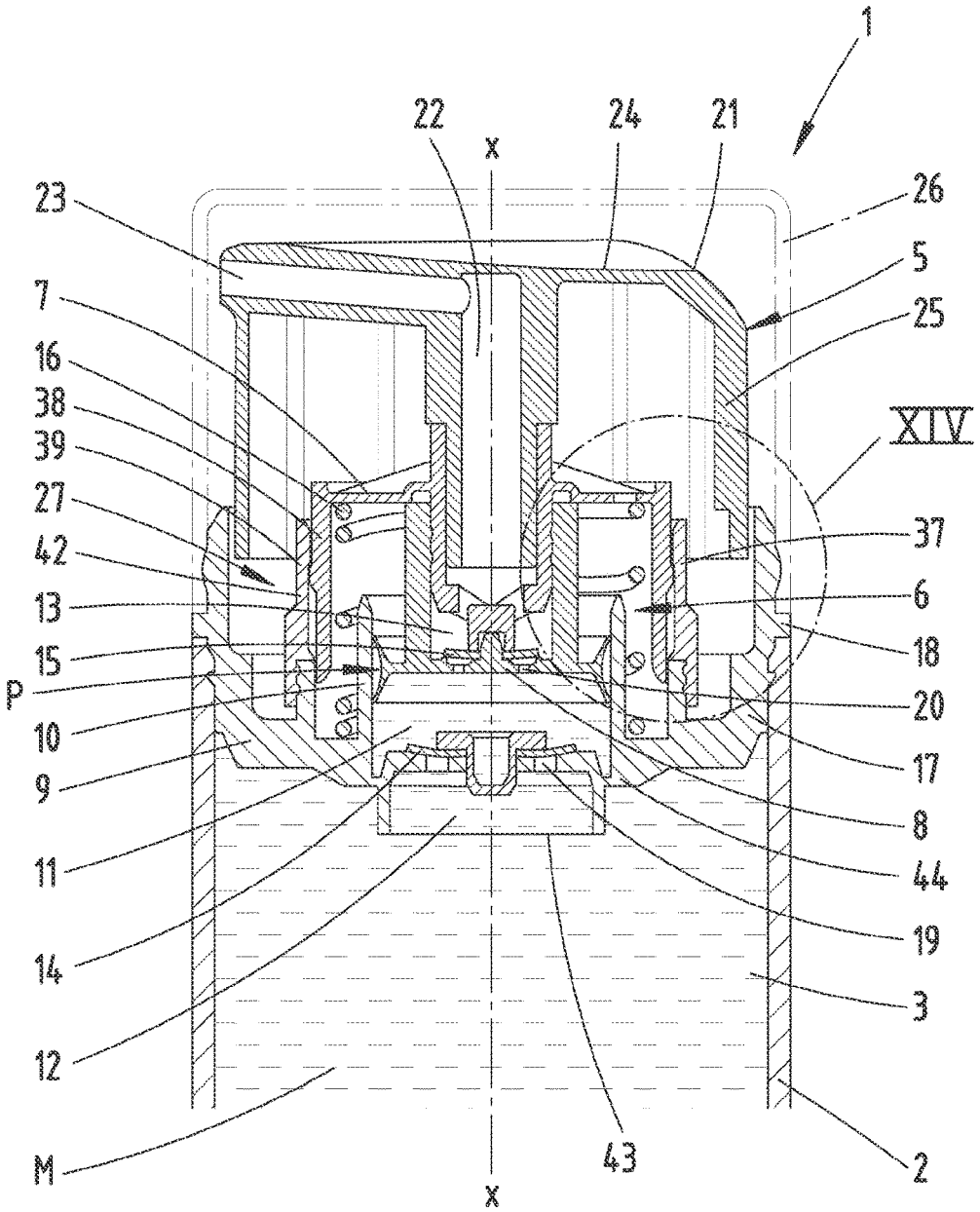
FIG. 13 shows a fifth embodiment of a dispenser according to the representation in FIG. 1.

According to the illustrations in FIGS. 10 to 12, an exchange part 37, which is altogether realized in an approximately annular manner, is provided and can be clipped, e.g., into an annular groove 33 on the outer side of the cup wall 17. A collar 31, which freely protrudes radially inward beyond the annular end face of the cup wall 17, interacts with a supporting collar 32, which protrudes radially outward, in the region of the actuating part wall 25 of the head piece 5 in a stop-limiting manner such that the pumping stroke b illustrated in FIG. 11 is realized. In this case, the free end face of the cup wall 17 forms the lower limitation for the displacement of the head piece 5 together with the piston 8.

FIG. 12 shows an arrangement, in which the length of an exchange part 37 in the direction of the longitudinal axis x is reduced in comparison with the exchange part 37 illustrated in FIG. 10, wherein the axial length a' of said exchange part obviously is chosen shorter than the length a of the exchange part 37 used in FIG. 10.

The reduced length a' accordingly results in a reduced pumping stroke b' (compare to FIG. 12).

Furthermore, a pumping stroke limitation, preferably a limitation in both directions, can also be realized due to the interaction of limiting devices, 27 between the piston part wall 38 and a guide wall 39 of the cup part 9, which circumferentially encompasses said the piston part wall. This makes it possible to achieve an internal limitation of the pumping stroke, which basically is not visible from outside. To this end, the piston part wall 38 may on its outer side to have a projection 40 that penetrates into a groove 41 formed on the inner side of the guide wall 39. In this case, the axial length of the groove 41 defines the maximally possible pumping stroke b.

According to the exemplary embodiment shown, the guide wall 39, particularly the section 42 of the guide wall 39 comprising the groove 41, is realized in the form of an exchange part 37 and can be assigned to a stop of the guide wall 39 of the cup part. For example, a clip-on connection or a screw connection may be provided in this case.

Figure 14:
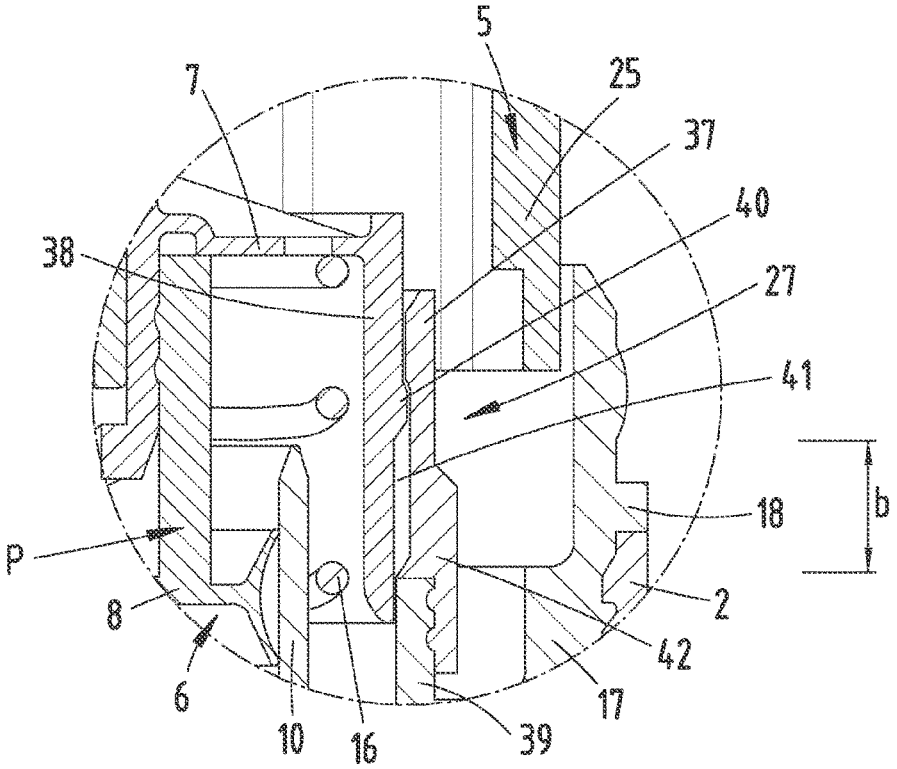
FIG. 14 shows an enlarged detail of the region XIV in FIG. 13.
Figure 15:
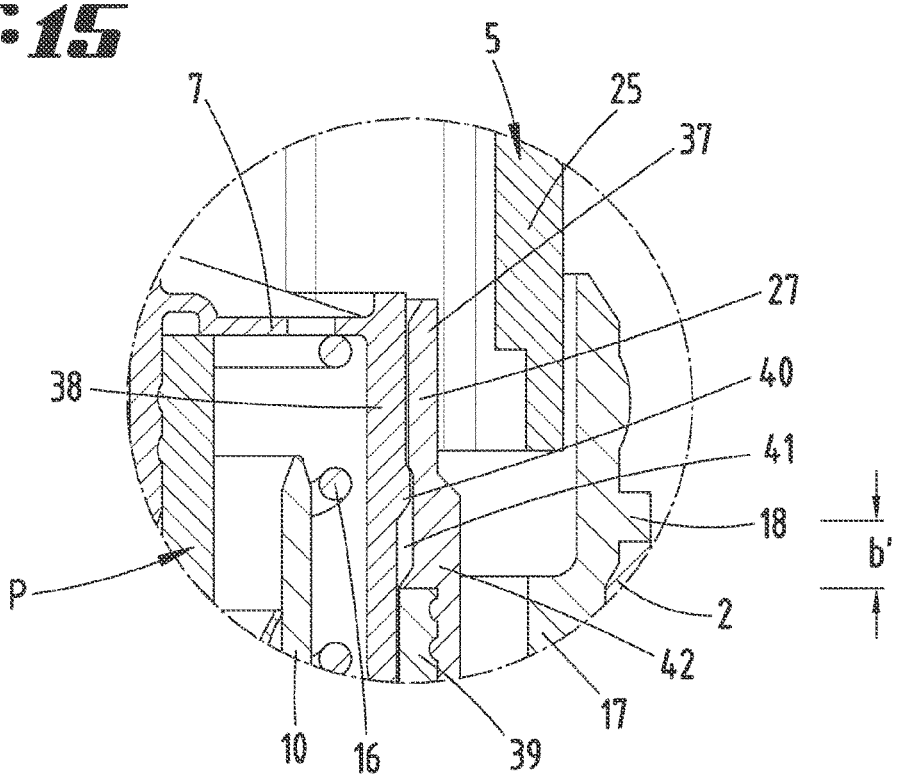
FIG. 15 shows an enlarged detail corresponding to FIG. 14 and concerning the arrangement of a changed limiting device.

FIGS. 14 and 15 show two corresponding exchange parts 37 or sections 42 with different axial lengths of the grooves 41 for adjusting different pumping strokes b and b'.

This also allows a simple adaptation of the pumping stroke as a result of the corresponding arrangement of an exchange part 37 within the dispenser 1.

FIGS. 16 to 19 show another embodiment, in which the limiting device 27 is similar to the embodiment illustrated in FIGS. 4 to 6 realized in the form of an annular adjusting part 28 and positioned between the actuating part wall 25 of the head piece 5 and the wall of the head part 9, which circumferentially encompasses this actuating part wall 25.

In this case, the adjusting part 28 also interacts with an internal thread 30 in the region of the cup part wall 17 in a threaded manner.

Furthermore, the adjusting part 28 is rotationally coupled with the head piece 5 such that a rotation of the head piece relative to the reservoir 2 about the longitudinal axis x results in a linear displacement of the adjusting part 28 along the longitudinal axis x due to the rotational coupling and the thread engagement between the adjusting part 28 and the cup part 9.

The rotational coupling may be achieved as a result of driving ribs 47, which are integrally formed on the inner side of the adjusting part wall 45 and protrude radially inward, wherein said driving ribs engage into assigned and axially oriented slot openings 47 in the region of the actuating part wall 25.

The driving ribs 46 may according to the illustrations also define the stop for the head piece 5 in the course of a pressing/downward displacement of the head piece 5 for the portioned discharge of the compound M, e.g. as a result of the interaction with the surface 48 of the actuating part wall 25 delimiting the slot opening 47 as shown.

Figure 16:
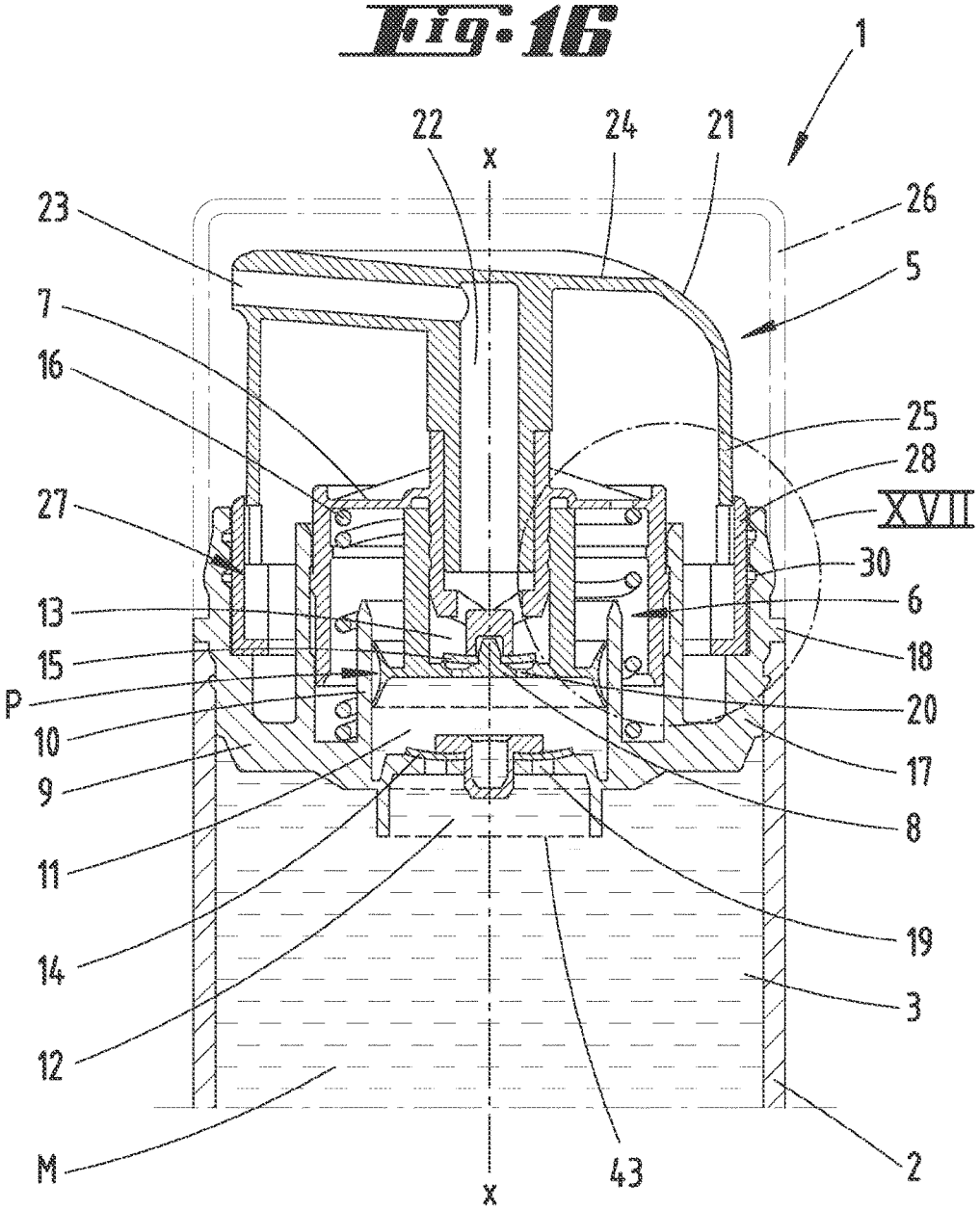
FIG. 16 shows a representation essentially corresponding the FIG. 1 and concerning another embodiment in a first position.
Figure 17:
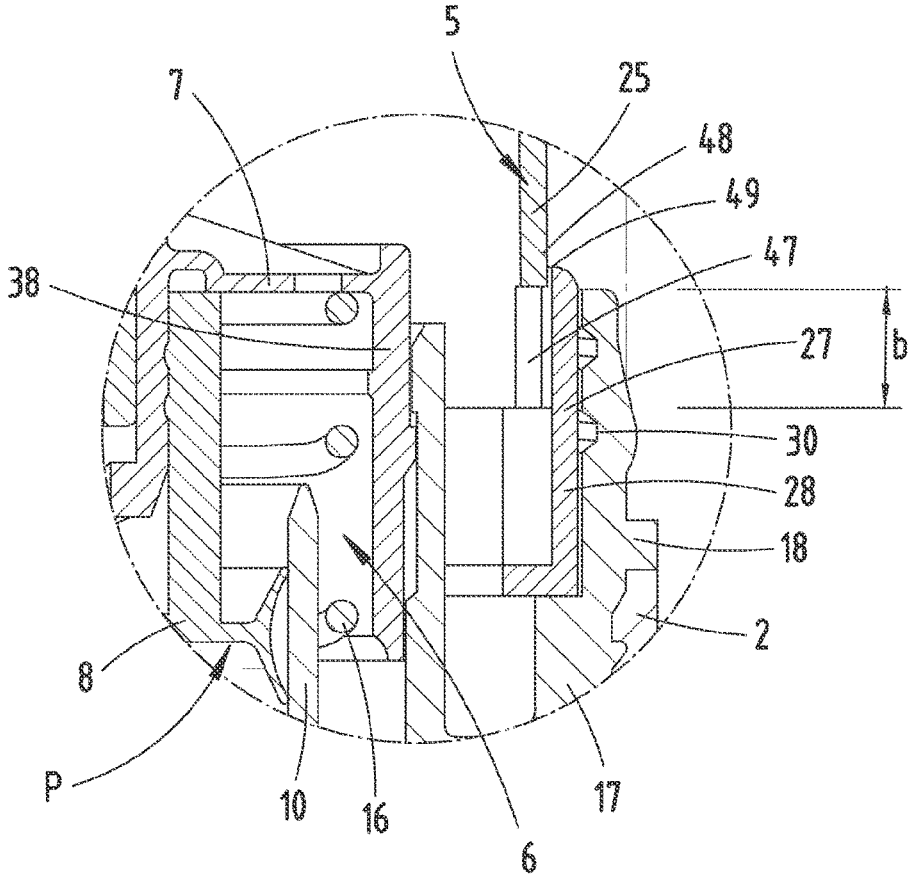
FIG. 17 shows an enlarged detail of the region XVII in FIG. 16.

In FIGS. 16 and 17, the adjusting part 28 is moved into a first (lower) stop-limited position. This stop limitation may be realized as a result of the formation of a stopping step on the cup part 9 as shown. It is furthermore preferred that the second (upper) position (see FIGS. 18 and 19) is also stop-limited.

According to the exemplary embodiment, the first (lower) position according to FIGS. 16 and 17 is the position, in which a maximum pumping stroke b can be achieved. In a non-actuated idle position of the head piece 5, the surface 48 of the slot opening 47 is axially spaced apart from the facing end face of the driving rib 46 of the adjusting part 28.

Figure 18:
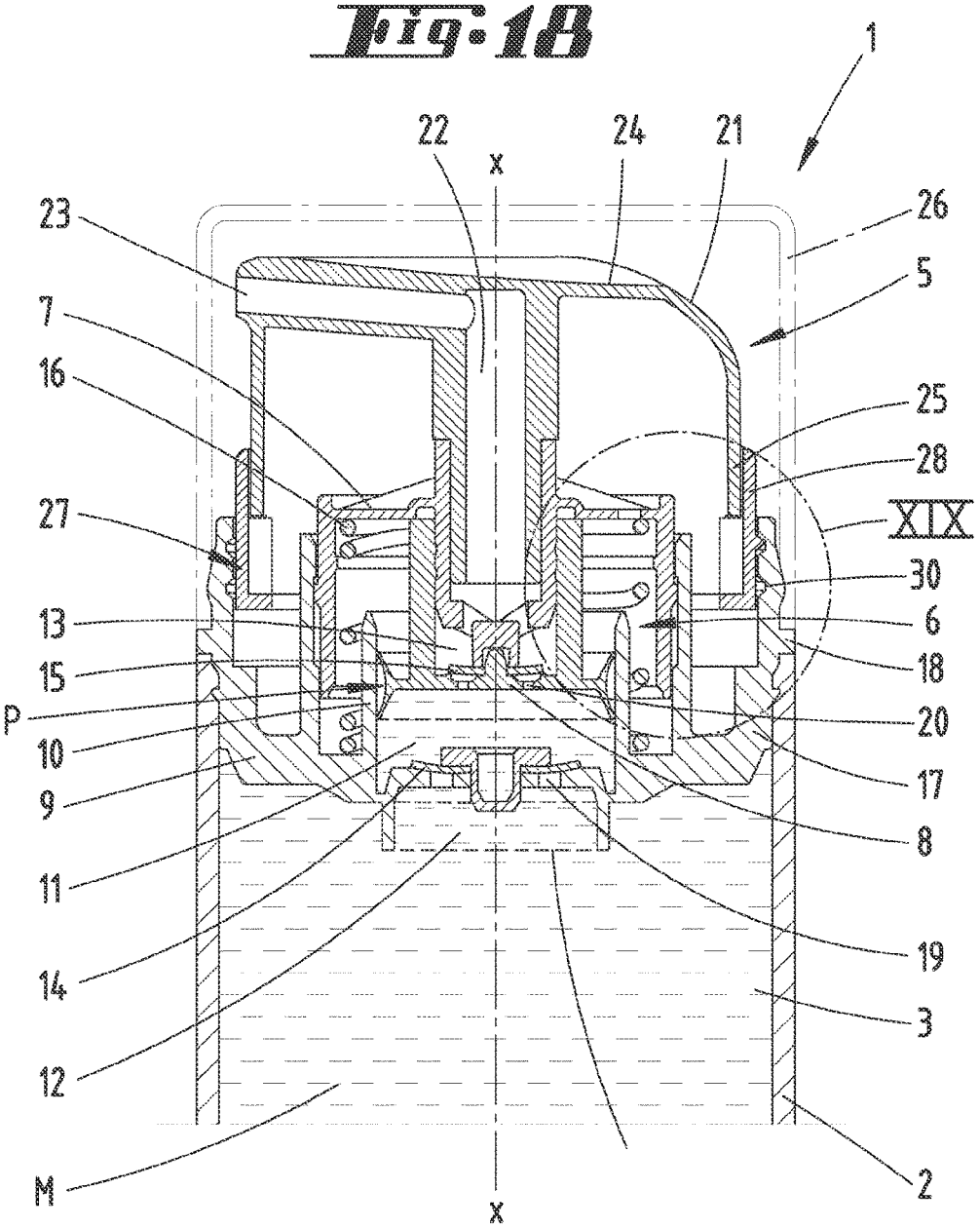
FIG. 18 shows a representation corresponding to FIG. 16, but concerning a second position of the variable limiting device.
Figure 19:
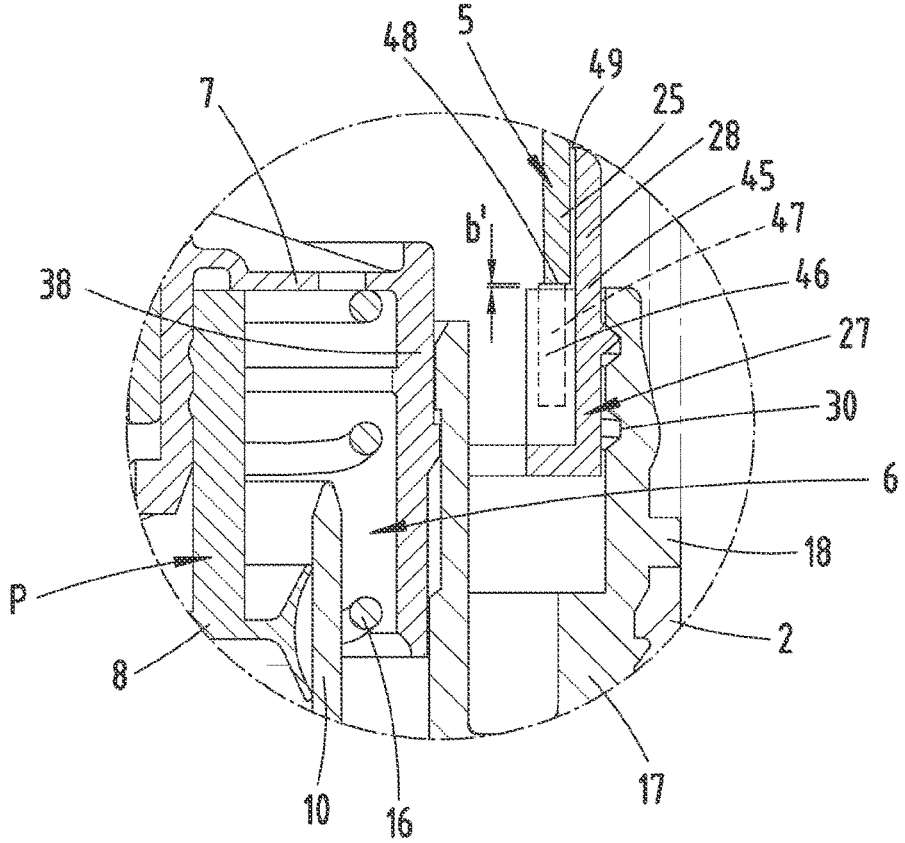
FIG. 19 shows a detail of the region XIX in FIG. 18.

According to the illustrations in FIGS. 18 and 19, the second (upper) position may be a position, in which no pumping stroke or only a minimum pumping stroke b' is allowed. The adjusting part 28 is axially displaced upward by means of the thread to such a degree that the surface 48 of the slot opening 47 of the head piece is spaced apart from the facing contact surface of the driving rib 46 not at all or only by a minimum distance. This position may also serve as transport position.

A rotational displacement of the head piece 5 makes it possible to assume any intermediate position of the limiting device 27, particularly between the first and the second position, in order to preferably adjust the discharge quantity of the compound M in a continuously variable manner.

The illustrations furthermore show that, as the pumping stroke is reduced as a result of an adjustment of the limiting device 27, the adjusting part wall 45 moves from a nearly concealed arrangement in the first (lower) position according to FIGS. 16 and 17 into a position, in which it freely protrudes axially beyond the facing upper outer edge of the cup part wall. This may furthermore be used, e.g., for providing a scale or the like on the outer side of the actuating part wall 25. This scale can be read in the non-actuated normal position of the head piece 5 by utilizing the upwardly directed free outer edge 49 of the adjusting part 28.

FIGS. 20 to 24 show a dispenser 1 with a limiting device 27, in which the pumping part P essentially is realized in the form of a membrane 50.

In this case, the cup part 9 may centrally form a double-walled plug receptacle 51 with a central cup-like elevation, in the cup ceiling 52 of which an inlet opening 53 is formed.

The pumping chamber 11 for discharging the compound M in a portioned manner is provided between the storage chamber 3 and the head piece 5. In the first position (starting position) of the first embodiment illustrated in FIGS. 20 to 22, in particular, this pumping chamber essentially extends above the plug receptacle 51 of the cup part 9.

Figure 20:
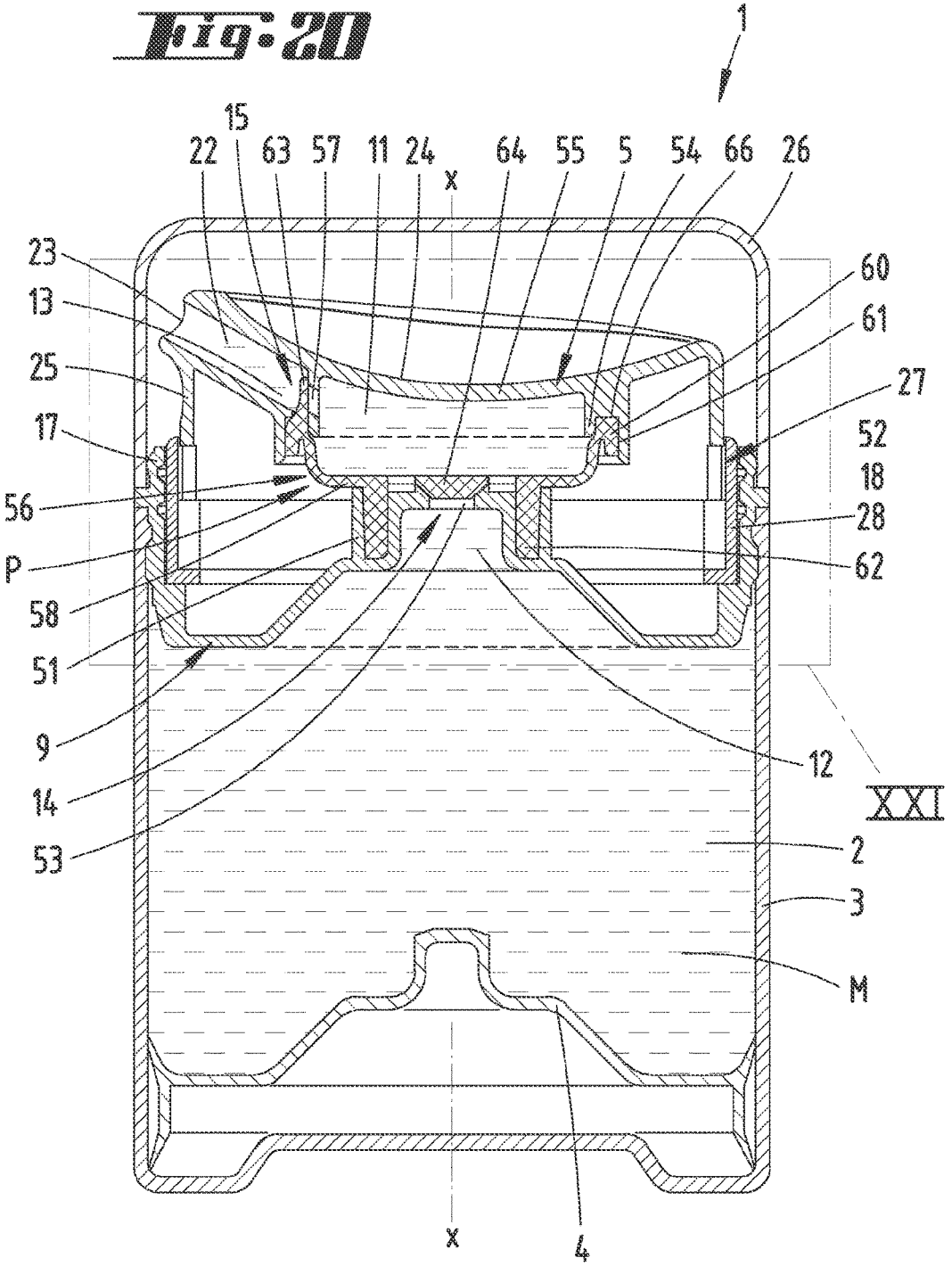
FIG. 20 shows a longitudinal section through a dispenser according to another embodiment concerning a first position of the variable limiting device.
Figure 21:
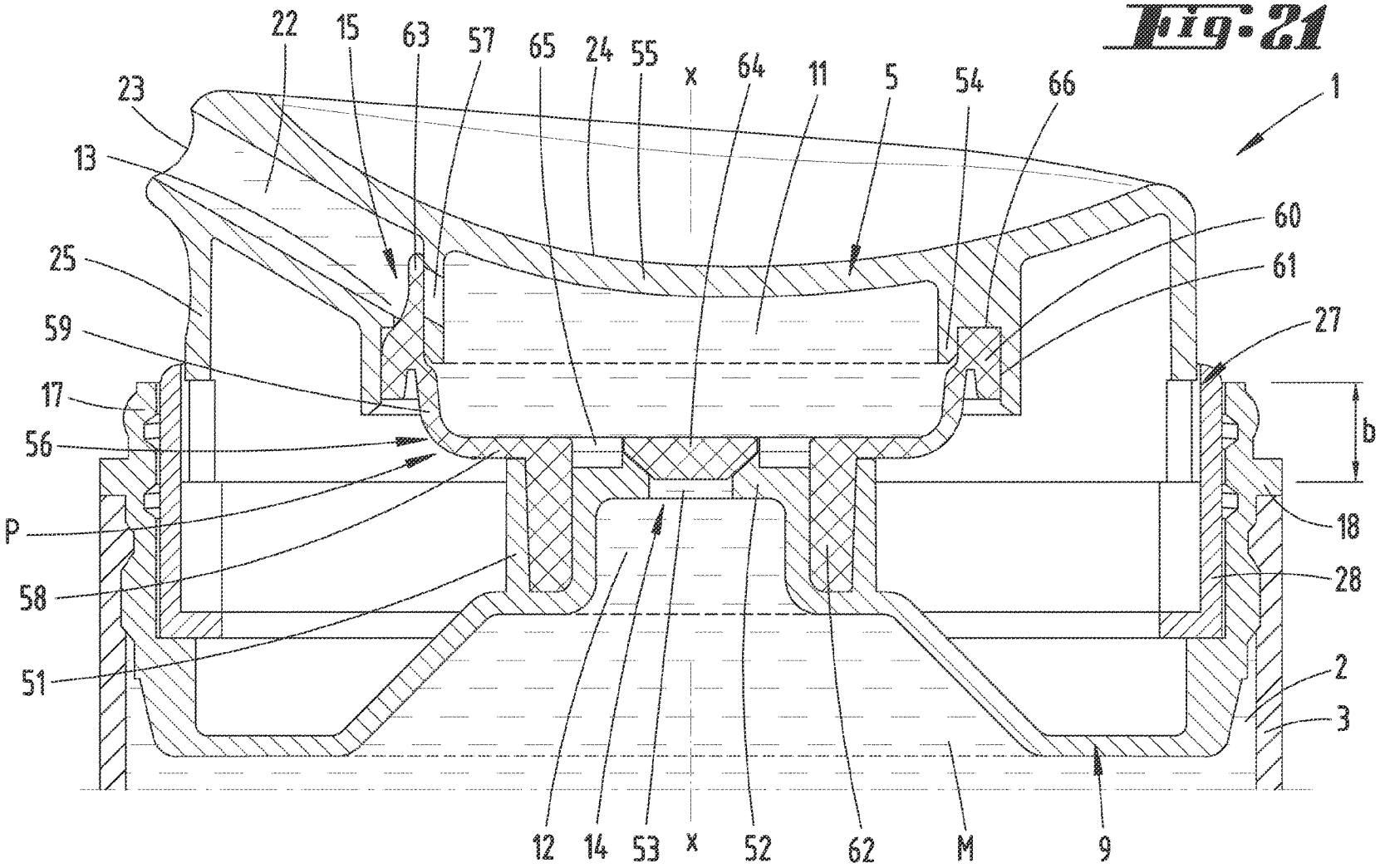
FIG. 21 shows an enlarged representation of the region XXI in FIG. 20 after the removal of a cap.
Figure 22:
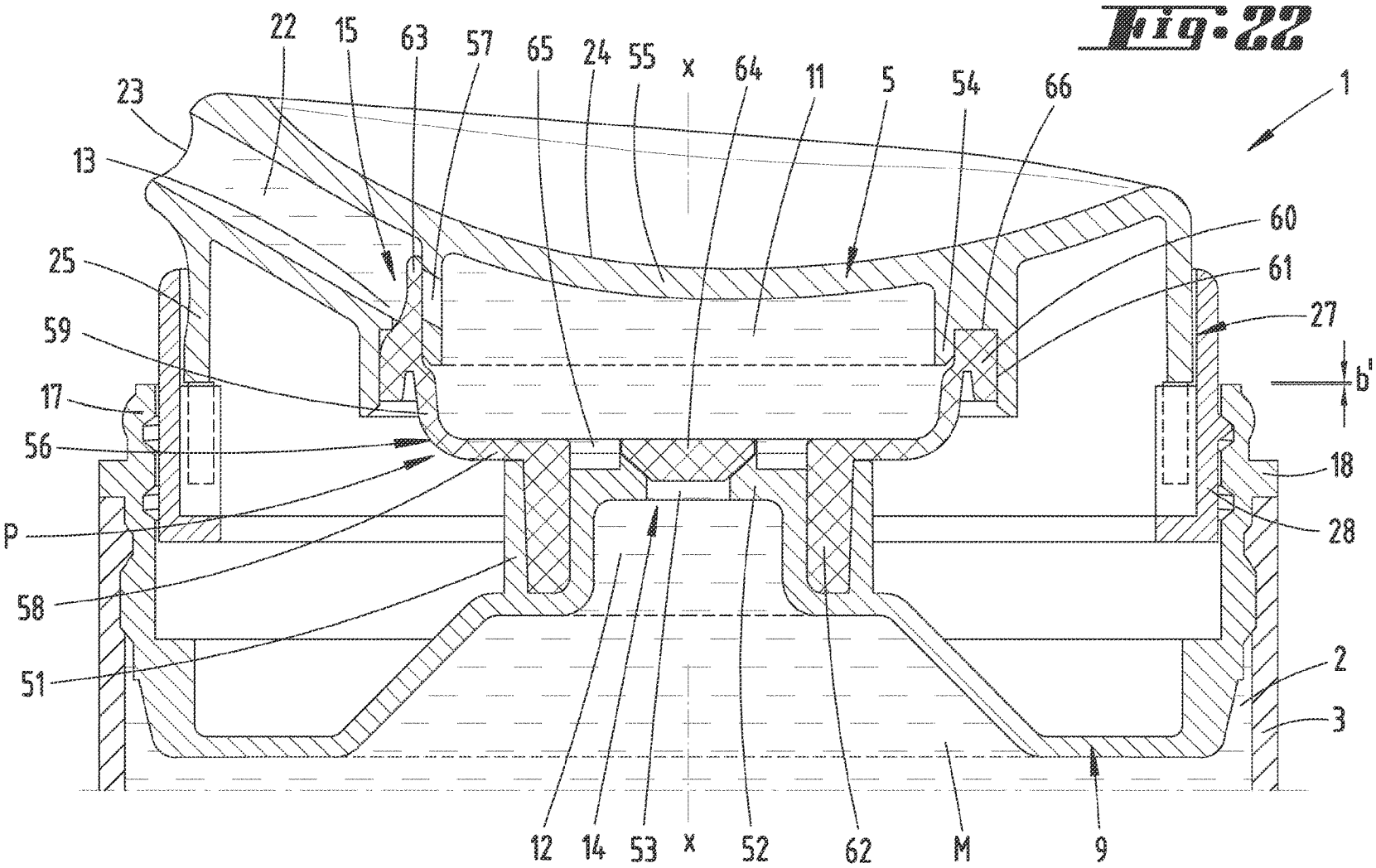
FIG. 22 shows a representation corresponding to FIG. 21 and concerning a second position of the limiting device.

With reference to the embodiment according to FIGS. 20 to 22, the pumping chamber 11 furthermore may be delimited circumferentially to the longitudinal axis x and over at least a partial vertical section by a radially inner sidewall 54 of the head piece 5, as well as by a ceiling section 55, which analogous to the sidewall 54 is realized integrally and uniformly in material with the head piece 5, on the ceiling side.

Another circumferential delimitation, which essentially follows the sidewall 54 vertically downward, as well as a vertically lower delimitation of the pumping chamber 11, preferably is realized with a spring element 56 formed by the membrane 50.

In this embodiment, the dispensing channel 22 is connected to the pumping chamber 11 by means of an outlet opening 57 formed in the sidewall 54.

The above-described spring element 56 preferably can be an injection-molded part consisting of a thermoplastic elastomer, optionally of silicone.

With respect to an unloaded position, which preferably can correspond to the first position or starting position according to FIGS. 20 and 21, the spring element 56 initially is shaped in a plate-like manner with a plate base, which in the starting position forms a limb 58 that in a vertical section essentially extends horizontally. In the region of its radially outer end, this horizontally oriented limb 58 preferably transforms integrally and uniformly in material into a curvature, which with respect to the graphic illustrations is directed vertically upward and furthermore transforms into an upward limb that is at least approximately oriented vertically. Accordingly, this upward limb forms the additional delimiting wall 59 for the pumping chamber 11 circumferentially to the longitudinal axis x.

The delimiting wall 59 transforms into a holding projection 60 in the vertically upper region facing away from the curvature. According to the illustrations, this holding projection may be accommodated in a groove-like holding receptacle 61, which is formed in the head piece 5 circumferentially to the longitudinal axis x and open vertically downward. In this case, the holding projection 60 preferably can be captured in the holding receptacle 61 in a form-fitting and/or frictionally engaged manner.

An annular plug projection 62 extends vertically downward from the limb 58, which essentially forms the plate bottom of the spring element 56 and in a vertical section extends horizontally. This plug projection engages into the groove-like plug receptacle 51 of the cup part 9 in a retentive manner.

The holding projection 60, as well as the plug projection 62, preferably can be realized integrally and uniformly in material with the plate-shaped spring element section. Furthermore, a valve section 63 for forming the valve 15 on the outflow side, as well as a valve plug 64 for forming the valve 14 on the inflow side, may be provided integrally and uniformly in material.

The valve section 63 may be integrally formed on the holding projection 60 in the region of its axially upper end in a tab-like manner. This valve section 63 extends into the dispensing channel 22 through a corresponding opening and places itself in front of the outlet opening 57 in a sealing manner in the closed valve position.

The valve plug 64 is connected to the region of the limb 58, which in the starting position extends horizontally, by means of webs 65 and closes the inlet opening 53 in a valve-like manner in the starting position.

Figure 23:
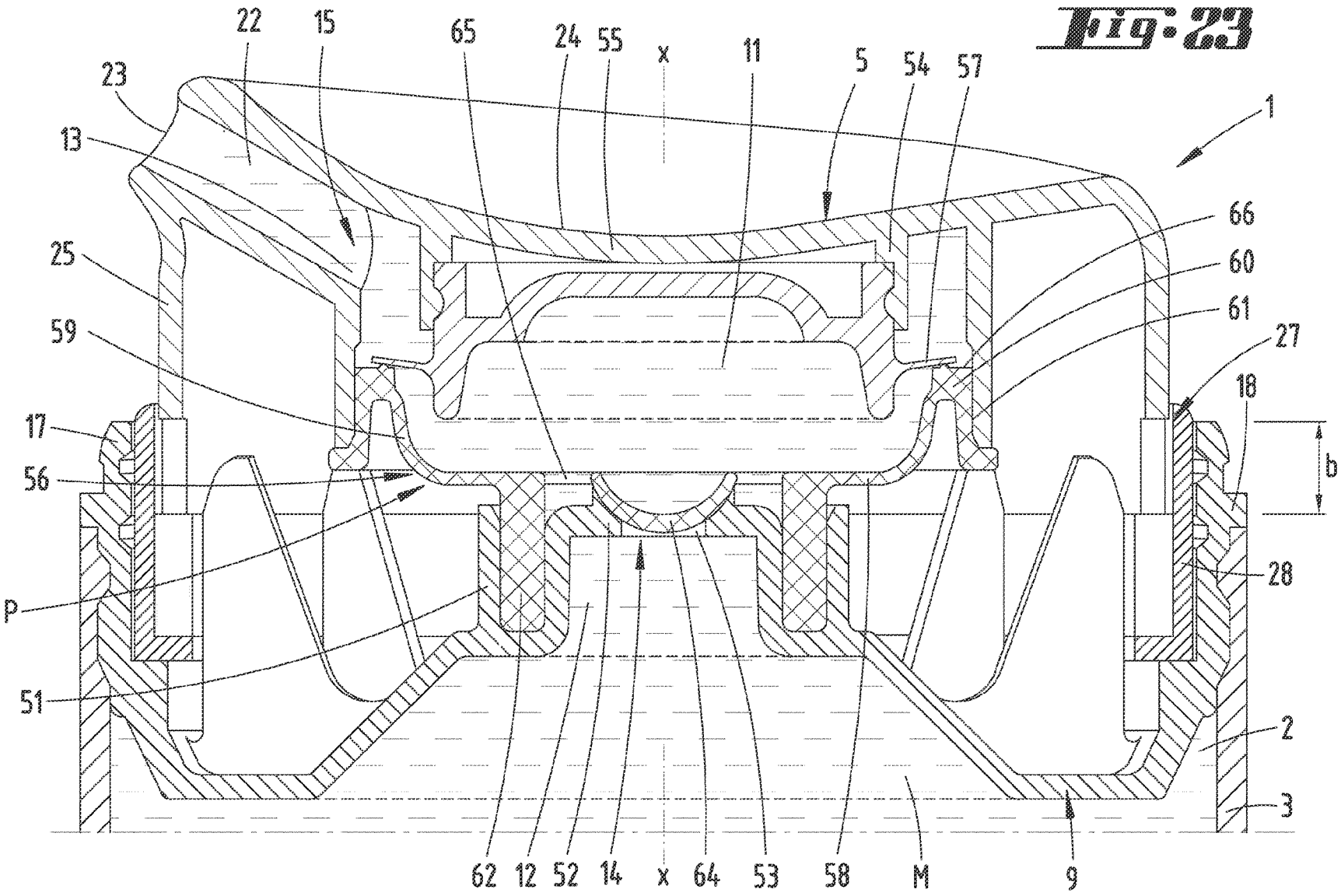
FIG. 23 shows another representation corresponding to FIG. 21, but concerning another embodiment.

FIGS. 23 and 24 show an embodiment, in which the pumping part P is likewise realized in the form of a membrane 50. In this embodiment, the holding projection 60 of the spring element 56 particularly is held in its position due to its radially outer contact with the sidewall 54 of the head piece 55. The holding receptacle 61 essentially is formed by the sidewall 54 in this case.

The holding projection 60 may have a supporting surface 66 that is exposed vertically upward. An annular projection, which has the bead-like cross section and is altogether realized concentric to the longitudinal axis x, may be formed on this supporting surface 66 and preferably interacts with a lip section 67 of the head piece 5 in order to form the valve 15 on the outflow side.

In this case, the lip section 67 essentially may be realized in the form of a flat part that essentially extends horizontally, particularly in an unloaded pre-assembly position. The lip section 67 preferably can be formed integrally and uniformly in material on a plug part 68, which is arranged on the head piece 5 and held on the head piece 5 on the underside of the actuating surface 24.

In the two embodiments illustrated in FIGS. 20 to 24, a reduction of the volume of the pumping chamber 11 can be achieved due to a linear downward displacement of the head piece 5 along the longitudinal axis x relative to the reservoir 2 such that a portioned discharge of the compound through the dispensing channel 22 and the dispensing opening 23 can be realized by opening the respective valve 15 on the outflow side.

These two embodiments preferably are provided with a limiting device 27. The limiting device 27 shown corresponds to the embodiment illustrated in FIGS. 16 to 19. Furthermore, the limiting devices 27 illustrated in FIGS. 1 to 15 can also be used in a dispenser 1 according to the embodiments in FIGS. 20 to 24.

Accordingly, an annular adjusting part 28 is in this case also provided between the actuating part wall 25 of the head piece 5 and the cup part wall 17 that circumferentially encompasses this actuating part wall 25.

Furthermore, the adjusting part 28 is rotationally coupled with the head piece 5 such that a rotation of the head piece relative to the reservoir 2 about the longitudinal axis x results in a linear displacement of the adjusting part 28 along the longitudinal axis x.

In FIGS. 20, 21 and 23, the adjusting part 28 is moved into a stop-limited first (lower) position. This preferably is the position, in which a maximum pumping stroke b can be achieved.

The second (upper) position illustrated in FIGS. 22 and 24 may be a position, in which no pumping stroke or only a minimum pumping stroke b' is allowed. To this end, the adjusting part 28 is correspondingly displaced axially upward. This position may also serve as transport position.

The preceding explanations serve for elucidating all inventions that are included in this application and respectively enhance the prior art independently with at least the following combinations of characteristics, wherein two, multiple or all of these combinations of characteristics may also be combined with one another, namely:

A dispenser 1, which is characterized in that a variable limiting device 27 is provided for variably limiting the pumping stroke b, and in that a change of the pumping stroke b corresponds to a change of the extension height.

A dispenser, which is characterized in that the restoring device 16 repositions the head piece 5 during a change of the pumping stroke b from a smaller pumping stroke b to a greater pumping stroke b.

A dispenser, which is characterized in that the cup part 9 has a cup bottom 44 and a cup wall 17, wherein the cup bottom 44 delimits the reservoir 2 toward the dispensing pump 6 and the cup wall 17 stands on the cup bottom 44 on the side of the head part and optionally serves for producing a snap-fit connection with the reservoir 2, and in that the limiting device 27 acts between the cup bottom 44, optionally on an exchange part 37 that is connected to the cup bottom 44, or the cup wall 17 and the head piece 5.

A dispenser, which is characterized in that the limiting device 27 consists of exchange parts 37, which can be used selectively in order to realize a desired pumping stroke b and have different dimensions in order to realize different pumping strokes b.

A dispenser, which is characterized in that the limiting device 27 consists of an adjusting part 28, which in a first adjustment position allows a greater pumping stroke than in a second adjustment position.

A dispenser, which is characterized in that the adjusting part 28 interacts with a stopping part 34, which is linearly guided on the adjusting part 28 in the direction of the longitudinal axis x of the dispenser 11.

A dispenser, which is characterized in that the stopping part 34 interacts with the head piece in a threaded manner.

A dispenser, which is characterized in that the head piece 5 is rotationally coupled with the adjusting part 28.

A dispenser, which is characterized in that the adjusting part 28 interacts with the cup part 9 in a threaded manner.

A dispenser, which is characterized in that a variable limiting device 27 is provided for variably limiting the pumping stroke b.

All disclosed characteristics are essential to the invention (individually, but also in combination with one another). The disclosure of the associated/attached priority documents (copy of the priority application) is hereby fully incorporated into the disclosure content of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

LIST OF REFERENCE SYMBOLS

1 Dispenser
2 Reservoir
3 Storage chamber
4 Follower piston
5 Head piece
6 Dispensing pump
7 Piston part
8 Piston
9 Cup part
10 Cylinder section
11 Pumping chamber
12 Inflow channel
13 Outflow channel
14 Valve on inflow side
15 Valve on outflow side
16 Restoring device
17 Cup wall
18 Fastening projection
19 Annular gap
20 Annular gap
21 Actuating part
22 Dispensing channel
23 Dispensing opening
24 Actuating surface
25 Actuating part wall
26 Cap
27 Limiting device
28 Adjusting part
29 External thread
30 Internal thread
31 Collar
32 Supporting collar
33 Annular groove
34 Stopping part
35 Guide web
36 Guide groove
37 Exchange part
38 Piston part wall
39 Guide wall
40 Projection
41 Groove
42 Section
43 Edge
44 Cup bottom
45 Adjusting part wall
46 Driving rib
47 Slot opening
48 Surface
49 Outer edge
50 Membrane
51 Plug receptacle
52 Cup ceiling
53 Inlet opening
54 Sidewall
55 Ceiling section
56 Spring element
57 Outlet opening
58 Limb
59 Delimiting wall
60 Holding projection
61 Holding receptacle
62 Plug projection
63 Valve section
64 Valve plug
65 Web
66 Supporting surface
67 Lip section
68 Plug part
a, a' Length
b, b' Pumping stroke
x Longitudinal axis F Stopping surface
H, H' Extension height
M Compound
P Pumping part

The invention claimed is:

1. A dispenser (1) for discharging flowable compounds (M) such as liquid or pasty compounds, wherein said dispenser comprises a reservoir (2) for accommodating the compound (M) and a dispensing pump (6), wherein the dispenser (1) has a longitudinal axis (x), wherein the dispensing pump (6) has an inflow channel and an outflow channel (12, 13) and a pumping chamber (11), which is delimited by valves (14, 15) on an inflow side and an outflow side, as well as a head piece (5), wherein the head piece (5) has a dispensing opening (23), wherein a pumping part (P) is configured to be moved relative to a cup part (9) against an elastic force of a restoring device (16) in order to achieve a pumping stroke (b), and wherein the head piece (5) is motion-coupled with the pumping part (P) such that a motion of the head piece (5) from a completely depressed position to an attainable extension height corresponds to the pumping stroke (b), wherein a variable limiting device (27) is provided for variably limiting the pumping stroke (b) and a change of the pumping stroke (b) corresponds to a change of the extension height so that a reduction of the pumping stroke (b) reduces the attainable extension height, wherein the cup part (9) has a cup bottom (44) and a cup wall (17), wherein the cup bottom (44) delimits the reservoir (2) toward the dispensing pump (6) and the cup wall (17) stands on the cup bottom (44) on the side of the head piece and serves for producing a connection with the reservoir (2), and wherein the limiting device (27) acts between the cup bottom (44) or the cup wall (17) and the head piece (5), and wherein the head piece has an actuating part (21) with an actuating part wall (25), the actuating part (25) being guided in an axial direction circumferentially by the cup wall (17) of the cup part (9).

2. The dispenser according to claim 1, wherein the restoring device (16) repositions the head piece (5) during a change of the pumping stroke (b) from a smaller pumping stroke (b) to a greater pumping stroke (b).

3. The dispenser according claim 1, wherein the limiting device (27) consists of an adjusting part (28), which in a first adjustment position allows a greater pumping stroke than in a second adjustment position.

4. The dispenser according to claim 3, wherein the adjusting part (28) interacts with a stopping part (34), which is linearly guided on the adjusting part (28) in the direction of the longitudinal axis (x) of the dispenser (11).

5. The dispenser according to claim 4, wherein the stopping part (34) interacts with the head piece in a threaded manner.

6. The dispenser according to claim 3, wherein the head piece (5) is rotationally coupled with the adjusting part (28).

7. The dispenser according to claim 6, wherein the adjusting part (28) interacts with the cup part (9) in a threaded manner.

8. The dispenser according to claim 1, wherein the cup wall produces a snap-fit connection with the reservoir.

9. A dispenser (1) for discharging flowable compounds (M) such as liquid or pasty compounds, wherein said dispenser comprises a reservoir (2) for accommodating the compound (M) and a dispensing pump (6), wherein the dispenser (1) has a longitudinal axis (x), wherein the dispensing pump (6) has an inflow channel and an outflow channel (12, 13) and a pumping chamber (11), which is delimited by valves (14, 15) on an inflow side and an outflow side, as well as a head piece (5), wherein the head piece (5) has a dispensing opening (23), wherein a pumping part (P) is configured to be moved relative to a cup part (9) against an elastic force of a restoring device (16) in order to achieve a pumping stroke (b), wherein the head piece (5) is motion-coupled with the pumping part (P) such that a motion of the head piece (5) from a completely depressed position to an attainable extension height corresponds to the pumping stroke (b), wherein a variable limiting device (27) is provided for variably limiting the pumping stroke (b) and a change of the pumping stroke (b) corresponds to a change of the extension height so that a reduction of the pumping stroke (b) reduces the attainable extension height, and wherein the limiting device (27) consists of exchange parts (37), which can be used selectively in order to realize a desired pumping stroke (b) and have different dimensions in order to realize different pumping strokes (b), and wherein the head piece has an actuating part (21) with an actuating part wall (25), the actuating part (25) being guided in the axial direction circumferentially by the cup wall (17) of the cup part (9).

10. The dispenser according to claim 9, wherein the cup part (9) has a cup bottom (44) and a cup wall (17), wherein the cup bottom (44) delimits the reservoir (2) toward the dispensing pump (6) and the cup wall (17) stands on the cup bottom (44) on the a side of the head part and serves for producing a snap-fit connection with the reservoir (2), and wherein the limiting device (27) acts between the cup bottom (44) or the cup wall (17) and the head piece (5).

11. The dispenser according to claim 9, wherein the cup wall produces a snap-fit connection with the reservoir.

12. A dispenser (1) for discharging flowable compounds (M) such as liquid or pasty compounds, wherein said dispenser comprises a reservoir (2) for accommodating the compound (M) and a dispensing pump (6) with a modular design, wherein the dispenser (1) has a longitudinal axis (x), wherein the dispensing pump (6) has an inflow channel and an outflow channel (12, 13) and a pumping chamber (11), which is delimited by valves (14, 15) on the inflow side and the outflow side, as well as a head piece (5), wherein the head piece (5) has a dispensing opening (23), wherein the dispensing pump (6) is configured to be inserted into the reservoir (2) and in the process connected to the reservoir (2) by means of a snap-fit connection, wherein the pumping chamber (11) is formed by a piston (8) and a cup part (9), which has a cup bottom (44) and a cup wall (17), wherein the piston (8) is accommodated in the cup part (9) in a slidable manner in order to achieve a pumping stroke (b), wherein the cup part (9) has on its outer wall fastening formations for fastening interaction with an inner wall of the reservoir (2), wherein the cup part (9) with the fastening formations Is realized in an exchangeable manner in order to be adapted to different reservoirs (2), wherein a fastening projection (18) is provided on a radial cup wall (17) of the cup part (9) in order to fix a position of the dispensing pump (6) in an installed state between the head piece (5) and the reservoir (2), wherein a restoring device (16) arranged between the piston (8) and the cup part (9) and limiting devices (27) for limiting a restoring motion furthermore are provided, wherein said limiting devices (27) come in contact with one another at a maximum pumping chamber volume, wherein the head part (5) is configured to be attached to the dispensing pump (6) in an exchangeable manner and has the dispensing opening (23) and a dispensing channel (22), wherein the dispensing channel (22) is configured to be inserted into the outflow channel (13) of the dispensing pump (6), and wherein an insertion depth of the dispensing pump (6) into the reservoir (2) is so large that a lower edge (43) of the dispensing pump (6) with its inflow channel (12) is in direct contact with the compound (M) to be dispensed, wherein a variable limiting device (27) is provided for variably limiting the pumping stroke (b) in such a way that a limitation of the pumping stroke between a minimally possible pumping stroke and a maximally possible pumping stroke can be achieved, wherein the maximally possible pumping stroke can be variably limited, and wherein the dispenser is in a non-usage position covered by a cap (26), which is fixed in a region of the cup wall (17) in a snap-fitted manner while being axially supported on the fastening projection (18), and wherein the head piece has an actuating part (21) with an actuating part wall (25), the actuating part (25) being guided in the axial direction circumferentially by the cup wall (17) of the cup part (9).

13. The dispenser (1) according to claim 12, wherein the restoring device (16) directly repositions the head piece (5) due to an elastic pressing force during an adjustment from a smaller to a greater pumping stroke (b), wherein an increased extension height (H) is automatically adjusted.

* * * * *